US011794124B2

(12) United States Patent
Pease et al.

(10) Patent No.: US 11,794,124 B2
(45) Date of Patent: Oct. 24, 2023

(54) CONNECTION SYSTEMS FOR TOY CONSTRUCTION PIECES, TOY CONSTRUCTION PIECES INCLUDING THE SAME, AND TOY CONSTRUCTION KITS INCLUDING THE SAME

(71) Applicant: Snap Ships LLC, Tarzana, CA (US)

(72) Inventors: Scott M. Pease, Tarzana, CA (US); Jeffrey Swenty, North Hills, CA (US)

(73) Assignee: Snap Ships LLC, Tarzana, CA (US)

( * ) Notice: Subject to any disclaimer, the term of this patent is extended or adjusted under 35 U.S.C. 154(b) by 106 days.

(21) Appl. No.: 16/585,566

(22) Filed: Sep. 27, 2019

(65) Prior Publication Data

US 2020/0101396 A1 Apr. 2, 2020

Related U.S. Application Data

(60) Provisional application No. 62/740,005, filed on Oct. 2, 2018.

(51) Int. Cl.

| | |
|---|---|
| ***A63H 33/10*** | (2006.01) |
| ***A63H 33/04*** | (2006.01) |
| ***A63H 17/00*** | (2006.01) |

(52) U.S. Cl.

CPC ..... *A63H 33/101* (2013.01); *A63H 17/002* (2013.01); *A63H 33/044* (2013.01)

(58) Field of Classification Search

CPC .... A63H 33/04; A63H 33/101; A63H 33/065; A63H 33/102; A63H 17/264; A63H 23/005; A63H 17/002; A63H 33/044; A63F 9/12; A63F 9/1208

See application file for complete search history.

(56) References Cited

U.S. PATENT DOCUMENTS

| | | | | |
|---|---|---|---|---|
| 956,632 A | | 5/1910 | Finch | |
| 2,119,921 A | * | 6/1938 | Levy | A63H 33/062 446/116 |
| 2,885,822 A | | 5/1959 | Onanian | |
| 3,195,266 A | * | 7/1965 | Onanian | A63H 33/101 446/86 |
| 3,496,670 A | | 2/1970 | Sloop et al. | |
| 3,518,786 A | * | 7/1970 | Holtvoigt | A63H 33/04 446/85 |

(Continued)

*Primary Examiner* — Melba Bumgarner
*Assistant Examiner* — Amir A Klayman
(74) *Attorney, Agent, or Firm* — Kolitch Romano Dascenzo Gates LLC

(57) ABSTRACT

Connection systems for toy construction pieces, toy construction pieces, and toy construction kits. A connection system includes a male connection element and a female connection element. The male connection element includes a peg unit with a connector peg. The female connection element includes at least a portion of a connector core that defines a receiver cavity configured to receive at least a portion of the connector peg and at least a portion of a core shell. A toy construction kit for assembling a constructed assembly includes a plurality of toy construction pieces that collectively embody the connection system. A first construction piece includes the male connection element and a second construction piece includes the female connection element. The connection system is configured to selectively and repeatedly couple the first construction piece and the second construction piece to one another.

35 Claims, 15 Drawing Sheets

(56) References Cited

U.S. PATENT DOCUMENTS 3,670,449 A 6/1972 Lemkin et al.
3,689,075 A 9/1972 Adelsohn
3,695,649 A * 10/1972 Laverone ..... F16B 9/056 403/402
3,785,651 A 1/1974 Smith
3,811,683 A * 5/1974 Street ..... A63F 9/12 273/157 R
3,816,957 A * 6/1974 Nakajima ..... A63H 3/46 446/379
4,003,144 A * 1/1977 Maddestra ..... A63F 9/0098 434/403
4,026,065 A * 5/1977 Dick ..... A63H 33/108 446/121
4,148,488 A * 4/1979 Kohlhagen ..... A63F 9/04 273/146
4,159,592 A * 7/1979 Gabriel ..... A63H 33/101 24/287
4,176,582 A * 12/1979 Witte ..... F16B 31/02 411/7
4,214,402 A * 7/1980 Ogawa ..... A63H 17/002 446/90
4,222,304 A * 9/1980 Yoshida ..... F16B 5/126 411/34
4,306,373 A 12/1981 Chatani et al.
4,381,618 A * 5/1983 Krisel ..... A63H 3/16 428/16
4,538,394 A * 9/1985 Farnum ..... G03B 37/00 52/664
4,604,073 A * 8/1986 Livesey ..... A63H 33/065 446/117
4,888,837 A * 12/1989 Wang ..... A47D 7/00 5/93.1
5,000,713 A * 3/1991 Cheng ..... A63H 33/06 273/160
5,074,094 A 12/1991 Gassler
5,261,666 A 11/1993 Chen et al.
5,306,198 A * 4/1994 Forman ..... A63F 9/0098 446/116
5,317,828 A * 6/1994 Yasui ..... A01K 87/00 156/190
5,373,616 A * 12/1994 Biersdorf ..... A63B 60/06 29/235
5,458,522 A * 10/1995 Brooks, III ..... A63H 33/048 446/85
5,645,464 A 7/1997 Chen
5,819,458 A * 10/1998 Hadden ..... G09F 1/12 40/782
5,964,634 A 10/1999 Chang
6,089,941 A * 7/2000 Glickman ..... A63H 33/101 446/108
6,322,414 B1 11/2001 Lin
D464,682 S * 10/2002 Lin ..... D21/499
6,605,914 B2 8/2003 Yim et al.
6,648,714 B1 * 11/2003 Kuo ..... A63H 33/065 446/120
6,711,865 B2 * 3/2004 Chaudoreille ..... A47B 87/0215 52/592.4
6,878,059 B2 * 4/2005 Boeru ..... A63F 3/00094 273/113
7,044,825 B2 * 5/2006 Glickman ..... A63H 33/102 446/121
7,137,639 B2 * 11/2006 Meggiolan ..... B62K 19/18 280/281.1
7,201,374 B2 * 4/2007 Bielman ..... A63F 11/0074 273/255
7,481,692 B2 1/2009 Bruder
7,596,473 B2 9/2009 Hansen et al.
7,905,757 B1 * 3/2011 Stapleton ..... A63H 33/04 446/85
8,382,548 B2 2/2013 Maggiore et al.
8,403,723 B1 * 3/2013 Haner ..... A63H 23/005 446/120
8,540,545 B2 * 9/2013 Leicht ..... A63H 33/106 446/118
8,801,491 B2 * 8/2014 Bruder ..... A63H 33/101 446/124
9,126,086 B2 * 9/2015 Howard, II ..... A63B 47/00
9,345,983 B2 * 5/2016 Meys ..... A63H 33/062
9,377,042 B2 * 6/2016 De Wilde ..... A63H 33/062
9,539,520 B2 * 1/2017 Rotbard ..... A63H 33/042
9,649,573 B2 * 5/2017 Phamdo ..... A63H 33/103
9,839,860 B2 * 12/2017 Rakhsha ..... A63H 33/04
9,901,941 B2 2/2018 Ryaa
10,343,079 B1 * 7/2019 Semling ..... A63H 33/062
10,343,080 B2 * 7/2019 Jang ..... A63H 33/086
10,376,804 B2 8/2019 Lu
D864,309 S * 10/2019 Barwald ..... D21/373
10,617,968 B2 4/2020 Davis
10,646,787 B2 * 5/2020 Cheung ..... A63H 27/001
10,756,300 B2 * 8/2020 Lee ..... H01L 51/5253
11,141,674 B2 * 10/2021 Zenevics ..... A63H 33/12
11,148,066 B2 * 10/2021 Zhu ..... F21V 21/108
11,351,473 B2 * 6/2022 Lee ..... A63H 33/088
2005/0272301 A1 * 12/2005 Bruder ..... A63H 33/107 439/409
2008/0236510 A1 10/2008 Silverman
2009/0093182 A1 * 4/2009 Jacobs ..... A63H 33/008 446/120
2010/0077568 A1 * 4/2010 Gill ..... A63B 53/14 16/421
2010/0210173 A1 * 8/2010 Maggiore ..... A63H 33/086 446/125
2011/0028064 A1 2/2011 Christensen et al.
2011/0039474 A1 * 2/2011 Bruder ..... A63H 33/101 446/124
2011/0165819 A1 7/2011 Iida
2013/0062352 A1 * 3/2013 Tachibana ..... B64C 1/14 220/378
2013/0195547 A1 * 8/2013 De Wilde ..... A63H 33/101 403/330
2014/0272752 A1 * 9/2014 Huang ..... A61C 7/287 433/11
2014/0356063 A1 * 12/2014 Tung ..... F16B 5/065 403/374.4
2015/0202541 A1 * 7/2015 Oh ..... B29C 45/14008 446/85
2015/0202542 A1 * 7/2015 Sze ..... A63H 33/042 446/90
2015/0251104 A1 9/2015 Lange et al.
2015/0313386 A1 * 11/2015 McNamara ..... A47G 19/2272 220/715
2015/0343277 A1 * 12/2015 Franklin ..... A63B 53/047 473/314
2016/0081304 A1 * 3/2016 Nielsen ..... A23K 40/20 514/772.3
2016/0123360 A1 * 5/2016 Lin ..... F16C 11/0609 403/122
2016/0184725 A1 * 6/2016 Wong ..... A63H 30/04 446/268
2018/0044077 A1 * 2/2018 Teller ..... A45D 40/0068
2018/0193762 A1 * 7/2018 Hui ..... A63H 33/08
2018/0213851 A1 * 8/2018 O'Donnell ..... A41F 1/002

* cited by examiner

CONNECTION SYSTEMS FOR TOY CONSTRUCTION PIECES, TOY CONSTRUCTION PIECES INCLUDING THE SAME, AND TOY CONSTRUCTION KITS INCLUDING THE SAME

RELATED APPLICATION

This application claims priority under 35 U.S.C § 119(e) to U.S. Provisional Patent Application Ser. No. 62/740,005, which was filed on Oct. 2, 2018, the complete disclosure of which is hereby incorporated by reference.

FIELD

The present disclosure relates to connection systems for toy construction pieces, toy construction pieces including the same, and toy construction kits including the same.

BACKGROUND

Conventional toy construction pieces exhibit a number of shortcomings. For example, such conventional toy construction pieces often lack connective stability and may fall apart when handled roughly. Many toy construction pieces restrict the builder to construct along strictly orthogonal dimensions. Others consist of balls and rods that allow the user to construct a lattice-like structure but not a solid object. Thus, there exists a need for stable and versatile connection systems for toy construction pieces, toy construction pieces including the same, and toy construction kits including the same.

SUMMARY

Connection systems for toy construction pieces, toy construction pieces including the same, and toy construction kits including the same are disclosed herein. A connection system for toy construction pieces includes a male connection element and a female connection element. The male connection element includes a peg unit with a connector peg that extends along a peg axis. The female connection element includes at least a portion of a connector core that defines a receiver cavity and at least a portion of a core shell that extends on an exterior side of the connector core. The receiver cavity is configured to selectively and repeatedly receive at least a portion of the connector peg to selectively couple the male connection element and the female connection element to one another. The connector peg is configured to be selectively and repeatedly removed from the receiver cavity to selectively uncouple the male connection element and the female connection element. At least a portion of the connector core may be formed of a material that is different than a material that forms at least a portion of the connector peg.

A toy construction kit includes a plurality of toy construction pieces that includes at least a first construction piece and a second construction piece that collectively embody the connection system. The first construction piece includes the male connection element of the connection system and the second construction piece includes the female connection element. The connection system is configured to selectively and repeatedly couple the first construction piece and the second construction piece to one another. The toy construction kit is configured such that at least a subset of the plurality of toy construction pieces may be assembled to form at least one constructed assembly.

DETAILED DESCRIPTION

FIGS. 1-37 provide examples of connection systems 100, of toy construction pieces 20 including the connection systems, and/or of toy construction kits 10 including the toy construction pieces, according to the present disclosure. Elements that serve a similar, or at least substantially similar, purpose are labeled with like numbers in each of FIGS. 1-37, and these elements may not be discussed in detail herein with reference to each of FIGS. 1-37. Similarly, all elements may not be labeled in each of FIGS. 1-37, but reference numbers associated therewith may be utilized herein for consistency. Elements, components, and/or features that are discussed herein with reference to one or more of FIGS. 1-37 may be included in and/or utilized with any of FIGS. 1-37 without departing from the scope of the present disclosure.

In general, elements that are likely to be included in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a given embodiment without departing from the scope of the present disclosure.

Figure 1:
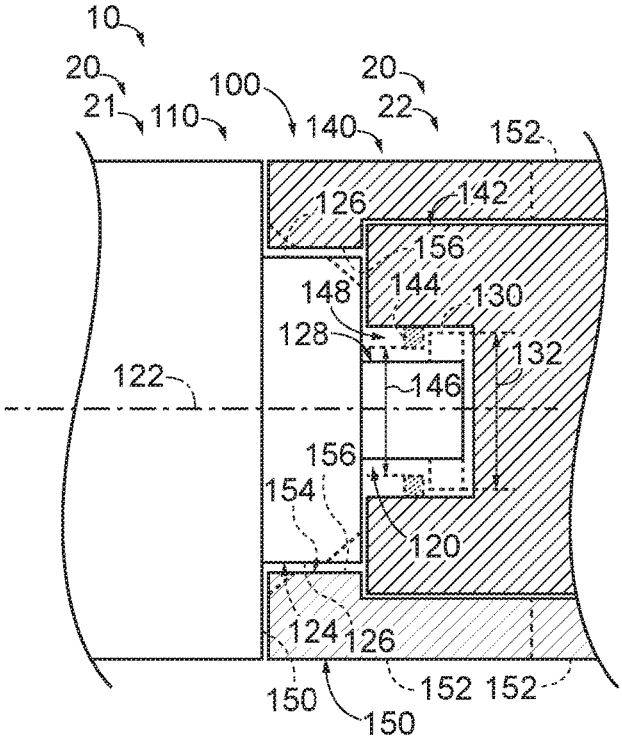
FIG. 1 is a schematic fragmentary cross-sectional elevation side view illustrating examples of connection systems according to the present disclosure.

FIG. 1 schematically illustrates examples of connection systems 100 for selectively connecting toy construction pieces 20 according to the present disclosure. Stated differently, FIG. 1 may be described as schematically illustrating portions of each of a pair of toy construction pieces 20 that collectively represent examples of connection systems 100. As schematically illustrated in FIG. 1, a connection system 100 includes a male connection element 110 with a peg unit 120 that includes a connector peg 128, and a female connection element 140 (shown in cross-section in FIG. 1) with a connector core 142 that defines a receiver cavity 148. In this manner, FIG. 1 may be described as schematically representing connection system 100 as operatively coupling a first toy construction piece 21, which includes male connection element 110, with a second toy construction piece 22, which includes female connection element 140. As schematically illustrated in FIG. 1, receiver cavity 148 is configured to receive at least a portion of connector peg 128 to operatively couple male connection element 110 to female connection element 140. More specifically, receiver cavity 148 is configured to selectively and repeatedly receive at least a portion of connector peg 128 to selectively and repeatedly couple male connection element 110 and female connection element 140 to one another. Additionally, connector peg 128 is configured to be selectively and repeatedly removed from receiver cavity 148 to selectively and repeatedly uncouple the male connection element and the female connection element.

Figure 2:
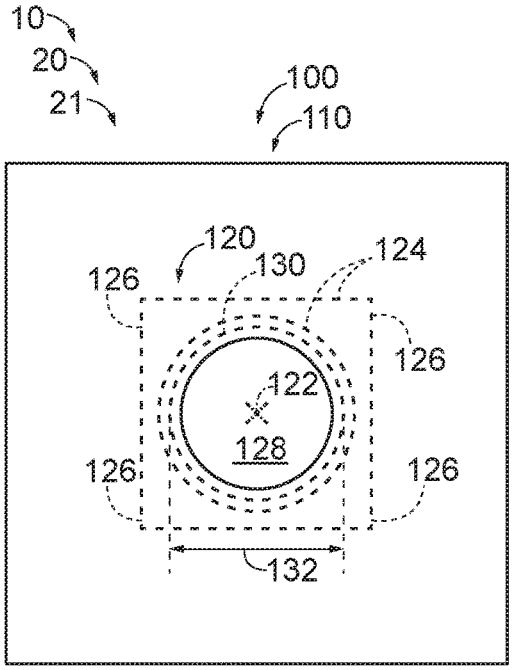
FIG. 2 is a schematic elevation end view illustrating examples of male connection elements according to the present disclosure.
Figure 3:
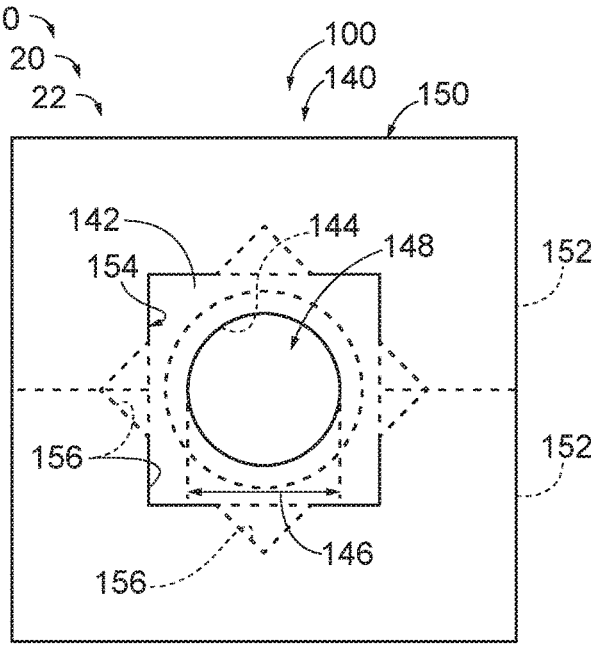
FIG. 3 is a schematic elevation end view illustrating examples female connection elements according to the present disclosure.

Examples of male connection elements 110 are further schematically illustrated in FIG. 2, while examples of female connection elements 140 are further schematically illustrated in FIG. 3. As schematically illustrated in FIGS. 1-2, connector peg 128 extends along a peg axis 122. As schematically illustrated in FIG. 1, peg unit 120 additionally may include a peg base 124 such that the connector peg extends away from the peg base along the peg axis. In such examples, and as schematically illustrated in FIG. 1, peg base 124 may extend away from a portion of toy construction piece 20 along peg axis 122.

As schematically illustrated in FIGS. 1 and 3, female connection element 140 additionally includes a core shell 150 that extends on an exterior side of connector core 142. Stated differently, and as schematically illustrated in FIGS. 1 and 3, an example of toy construction piece 20 that includes female connection element 140 additionally includes core shell 150 such that at least a portion of core shell 150 operates as a portion of female connection element 140. As described in more detail herein, it is additionally within the scope of the present disclosure that core shell 150 additionally or alternatively may be associated with and/or a component of male connection element 110. For example, while FIG. 1 schematically illustrates connector core 142 and core shell 150 as being associated with an example of toy construction piece 20 that includes female connection element 140, it is to be understood that an example of toy construction piece 20 that includes male connection element 110 also may include connector core 142 and/or core shell 150, such as may be associated with an instance of female connection element 140 of the same toy construction piece. As an example, and as further schematically illustrated in FIG. 1, peg unit 120, peg base 124, and/or connector peg 128 of male connection element 110 may extend away from and/or be positioned adjacent to core shell 150 of toy construction piece 20 that includes the male connection element. In this manner, and as described herein, a given (i.e., a specific) toy construction piece 20 may include one or more male connection elements 110 as well as one or more female connection elements 140.

For clarity, FIG. 1 schematically illustrates some components of toy construction pieces 20 as being spaced apart from one another. However, it is to be understood that the various components schematically illustrated in FIG. 1 as being adjacent but spaced apart may be in contact with one another, such as when male connection element 110 is operatively coupled to female connection element 140. For example, when male connection element 110 is operatively coupled to female connection element 140, at least a portion of connector peg 128 generally is in contact with and/or engages at least a portion of receiver cavity 148. As another example, connector core 142 of female connection element 140 generally is in contact with core shell 150 of the female connection element.

Receiver cavity 148 may be configured to receive connector peg 128 in any appropriate manner. As an example, receiver cavity 148 may be configured to receive connector peg 128 in a friction-fit engagement. Additionally or alternatively, receiver cavity 148 may be configured to receive connector peg 128 in a snap-fit engagement. As a more specific example, and as schematically illustrated in FIGS. 1-3, connector peg 128 may include a peg head 130 (illustrated in FIGS. 1-2), and connector core 142 may include a shoulder 144 (illustrated in FIGS. 1 and 3) that at least partially defines receiver cavity 148. In such an example, peg head 130 may have and/or be characterized by a peg head diameter 132 (illustrated in FIGS. 1-2), as measured in a direction at least substantially perpendicular to peg axis 122, that is larger than a shoulder diameter 146 of shoulder 144 (illustrated in FIGS. 1 and 3). In such an example, connector core 142, shoulder 144, and/or peg head 130 may be configured to resiliently deform to permit the peg head to pass into and out of receiver cavity 148. Stated differently, shoulder 144 may include and/or be an annular constriction that partially restricts peg head 130 from being fully inserted into and/or removed from the receiver cavity. Accordingly, shoulder 144 may engage peg head 130 such that the peg head may be inserted into and/or removed from receiver cavity 148 only upon receiving a force that is in excess of a threshold coupling force. In this manner, engagement of shoulder 144 and peg head 130 may produce a more stable connection between male connection element 110 and female connection element 140 relative to an otherwise identical connection system 100 that lacks the peg head and/or the shoulder.

While shoulder 144 generally is described and illustrated herein as extending around a full perimeter of receiver cavity 148, this is not required to all examples of connection system 100, and it is additionally within the scope of the present disclosure that the shoulder may extend only partially around the perimeter of the receiver cavity. Similarly, while peg head 130 generally is described and illustrated herein as extending around a full circumference of connector peg 128, this is not required to all examples of connection system 100, and it is additionally within the scope of the present disclosure that the peg head may extend only partially around the circumference of the connector peg.

Connector core 142 may include any appropriate number of receiver cavities 148. For example, receiver cavity 148 of female connection element 140 may be a first receiver cavity of a plurality of receiver cavities of the connector core 142 (such as may correspond to a corresponding plurality of female connection elements 140 of the connector core). As more specific examples, connector core 142 may include a total of two receiver cavities 148, three receiver cavities, four receiver cavities, five receiver cavities, six receiver cavities, or more than six receiver cavities.

As discussed, when present, core shell 150 generally extends on an exterior side of connector core 142. For example, core shell 150 may substantially cover connector core 142. As a more specific example, connector core 142 may be entirely contained within core shell 150. In such examples, and as schematically illustrated in FIG. 1, at least a portion of core shell 150 of an example of toy construction piece 20 that includes female connection element 140 may be positioned proximal a portion of male connection element 110 (e.g., a portion that excludes peg unit 120) relative to connector core 142 of the toy construction piece when the male connection element is operatively coupled to female connection element 140.

As schematically illustrated in FIGS. 1 and 3, core shell 150 may include a plurality of shell components 152 that are operatively coupled to one another to assemble the core shell. In such an example, connector core 142 may be positioned between the shell components to assemble toy construction piece 20 and/or female connection element 140. However, this is not required to all examples of connection system 100, and it is additionally within the scope of the present disclosure that connector core 142 may be integrally formed with core shell 150, such as via an overmolding process. As another example, core shell 150 may include the plurality of shell components 152, and connector core 142 may be integrally formed with at least one shell component of the plurality of shell components. In an embodiment of core shell 150 that includes the plurality of shell components 152, the plurality of shell components may be operatively coupled to one another in any appropriate manner, such as via adhesion and/or via a snap-fit engagement.

Connector peg 128, connector core 142, and/or core shell 150 may be formed of any appropriate respective materials, such as to permit peg head 130 and/or shoulder 144 (when present) to resiliently deform responsive to peg head 130 entering or exiting receiver cavity 148. As examples, connector core 142 may be formed of a plastic, a polymer, a rubberized plastic, a vinyl plastic, and/or a thermoplastic elastomer (TPE). Additionally or alternatively, connector peg 128 and/or core shell 150 may be formed of a plastic, a polymer, a thermoplastic polymer, acrylonitrile butadiene styrene (ABS), a metal, and/or a die-cast metal. In some examples, connector core 142 is formed of a material that is more resilient than connector peg 128. Additionally or alternatively, at least a portion of connector core 142 (such as shoulder 144) may be formed of a material that is more resilient than core shell 150. In such an example, connector peg 128 and core shell 150 may be formed of the same material. As additional examples, at least a portion of connector peg 128 (such as peg head 130) may be formed of a material that is more resilient than connector core 142 and/or that is more resilient than core shell 150. As a further example, at least a portion of connector peg 128 (such as peg head 130) and at least a portion of connector core 142 (such as shoulder 144) each may be formed of a resilient material, such as materials that each are more resilient than core shell 150. In such an example, peg head 130 and shoulder 144 each may resiliently deform as the peg head is inserted into and/or removed from receiver cavity 148. In other embodiments, connector core 142 and core shell 150 may be formed of the same material. Connector peg 128, connector core 142, and/or core shell 150 also may have any appropriate respective colors. For example, connector core 142 and core shell 150 may be different colors. Additionally or alternatively, core shell 150 may be formed of a material that is configured to be painted, such as by an end user of toy construction piece 20.

As further schematically illustrated in FIGS. 1 and 3, female connection element 140 may include an alignment guide 154 that is defined by core shell 150 and that receives at least a portion of peg base 124 when male connection element 110 is operatively coupled to female connection element 140. More specifically, in such an example, alignment guide 154 may include and/or be an aperture defined in core shell 150 such that the alignment guide is aligned with receiver cavity 148. As schematically illustrated in FIGS. 1 and 3, alignment guide 154 may include and/or define a plurality of alignment notches 156, such as may be configured to establish alignment between male connection element 110 and female connection element 140, thereby establishing alignment between toy construction pieces 20 that respectively include the male connection element and the female connection element. For example, and as schematically illustrated in FIGS. 1-2, peg base 124 may include and/or define a plurality of corners 126 such that each corner is at least partially received within a corresponding alignment notch 156 (schematically illustrated in FIGS. 1 and 3) when male connection element 110 is operatively coupled to female connection element 140. In such an example, when male connection element 110 is operatively coupled to female connection element 140, each corner 126 may engage and/or be received within the corresponding alignment notch 156, thereby at least substantially restricting the male connection element from rotating relative to the female connection element about peg axis 122. In this manner, the plurality of alignment notches 156 may be described as defining a plurality of discrete rotational orientations of peg base 124 relative to alignment guide 154 when male connection element 110 is operatively coupled to female connection element 140. Stated differently, in such examples, operatively coupling male connection element 110 to female connection element 140 may correspond to positioning peg base 124 relative to alignment guide 154 in one of the plurality of discrete rotational orientations defined by the plurality of alignment notches 156.

When present, the plurality of corners 126 may have any appropriate configuration. As an example, and as schematically illustrated in FIG. 2, the plurality of corners 126 may include four corners arranged in a square pattern. However, this is not required of all examples of peg base 124 that include the plurality of corners 126, and it is additionally within the scope of the present disclosure that the plurality of corners may include two corners, three corners, four corners, five corners, six corners, seven corners, eight corners, or more than eight corners. The plurality of corners 126 may be evenly distributed around the perimeter of peg base 124, or may be unevenly (e.g., asymmetrically) distributed around the perimeter of the peg base.

As additionally schematically illustrated in dashed lines in FIG. 1, peg base 124 and/or alignment guide 154 may include and/or be at least partially defined by a chamfered surface, such as to facilitate inserting each corner 126 into the corresponding alignment notch 156. While the examples illustrated and discussed in the present disclosure generally relate to examples in which female connection element 140 includes alignment guide 154 and/or male connection element 110 includes corners 126, this is not required to all examples of connection system 100, and it is additionally within the scope of the present disclosure that male connection element 110 may include the alignment guide and/or that female connection element 140 may include the corners that align with the alignment guide.

The plurality of alignment notches 156 may have any appropriate configuration. As an example, and as schematically illustrated in FIG. 3, the plurality of alignment notches 156 may include four alignment notches arranged in a square pattern. As another example, and as schematically illustrated in solid lines and in dashed lines in FIG. 3, the plurality of alignment notches 156 may include eight alignment notches arranged in a star-shaped pattern. As additional examples, the plurality of alignment notches 156 may include two alignment notches, three alignment notches, four alignment notches, five alignment notches, six alignment notches, seven alignment notches, eight alignment notches, or more than eight alignment notches. The plurality of alignment notches 156 may be evenly distributed around the perimeter of alignment guide 154, or may be unevenly (e.g., asymmetrically) distributed around the perimeter of the alignment guide.

In some examples of male connection element 110, peg base 124 may not include corners 126 and/or may not extend within any of the alignment notches 156 when the male connection element is operatively coupled to female connection element 140. For example, peg base 124 may be at least substantially cylindrical. In such an example, male connection element 110 may be free to rotate with respect to female connection element 140 about peg axis 122 while the male connection element is operatively coupled to the female connection element.

Turning now to FIGS. 4-37, FIGS. 4-33 illustrate examples of toy construction pieces 20 (and/or components thereof) that utilize connection system 100, while FIGS. 34-37 illustrate examples of toy construction kits 10 that include toy construction pieces 20. That is, a toy construction kit 10 according to the present disclosure includes a plurality of toy construction pieces 20 that include and/or utilize connection system 100. More specifically, and as schematically illustrated in FIG. 1 and less schematically illustrated in FIGS. 34-35, the plurality of toy construction pieces 20 may be described as including at least first toy construction piece 21 that includes male connection element 110 and second toy construction piece 22 that includes female connection element 140. In this manner, connection system 100 is configured to selectively and repeatedly couple first toy construction piece 21 and second toy construction piece 22 to one another and to selectively and repeatedly uncouple the first toy construction piece and the second toy construction piece from one another.

Toy construction kit 10 generally is configured such that at least a subset of the plurality of toy construction pieces 20 may be assembled to form at least one constructed assembly 30. As examples, FIGS. 36-37 illustrate constructed assemblies 30 corresponding to the toy construction kits 10 of FIGS. 34-35, respectively. Constructed assembly 30 may correspond to a toy for play by a user. As examples, constructed assembly 30 may take the appearance of a vehicle, an aircraft, a spaceship, a machine, a robot, and/or a building. Toy construction kit 10 may be configured such that the plurality of toy construction pieces 20 may be assembled into each of a plurality of unique constructed assemblies 30. In this manner, toy construction kit 10 may permit the user to build constructed assemblies 30 in a non-linear and/or open-ended manner that encourages creativity and unique designs.

Toy construction piece 20 may have any appropriate form and/or may be configured to be selectively coupled to any appropriate number of other toy construction pieces. As an example, toy construction piece 20 may include and/or be a structural block 40 that is configured to be selectively coupled to each of at least two other toy construction pieces of the plurality of toy construction pieces of toy construction kit 10. In such an example, structural block 40 may include at least one instance of male connection element 110 and/or at least one instance of female connection element 140. Structural block 40 may be configured to contribute to a structure, such as an interior structure, of constructed assembly 30. For example, structural block 40 may be at least substantially concealed from view when the plurality of toy construction pieces 20 are assembled into constructed assembly 30. Structural block 40 may assume any appropriate shape. As examples, structural block 40 may be at least substantially in the shape of a polygonal prism such as a triangular prism, a rectangular prism, a cube, a pentagonal prism, and/or a hexagonal prism. As another example, structural block 140 may be at least substantially cylindrical. Examples of structural blocks 40 and/or components thereof are illustrated in FIGS. 4-16, 18-19, 23, 28, and 32-33, as discussed below.

As another example, toy construction piece 20 may include and/or be a detail piece 50 that takes the appearance of a component of an outer surface of constructed assembly 30. Stated differently, detail piece 50 may be shaped and/or formed to resemble a component of constructed assembly 30. As more specific examples, detail piece 50 may take the appearance of a passenger module, a cockpit, an engine, a jet engine, a rocket engine, a turbofan engine, an exhaust port, an aerodynamic surface, a wing, an aerodynamic stabilizer, a rudder, a fin, a weapon, a gun, a missile bank, a storage tank, a fuel tank, a communications device, an antenna, a satellite dish, a wheel, a humanoid arm, a humanoid leg, a humanoid head, a wall, a window, a door, etc. Examples of detail pieces 50 and/or components thereof are illustrated in FIGS. 20 and 25-33, as discussed below.

As yet another example, toy construction piece 20 may include and/or be a terminal piece 60 that is configured to be selectively coupled to one other toy construction piece 20 of the plurality of toy construction pieces of toy construction kit 10. Thus, for example, terminal piece 60 may include one instance of male connection element 110 or one instance of female connection element 140. Examples of terminal pieces 60 and/or of components thereof are illustrated in FIGS. 25-27 and 29-31, as discussed below. As another example, in an embodiment of terminal piece 60 that includes one instance of female connection element 140, the terminal piece may be utilized to "cap off" an unused connector peg 128 when assembling constructed assembly 30, such as to conceal the unused connector peg from view.

Figure 23:
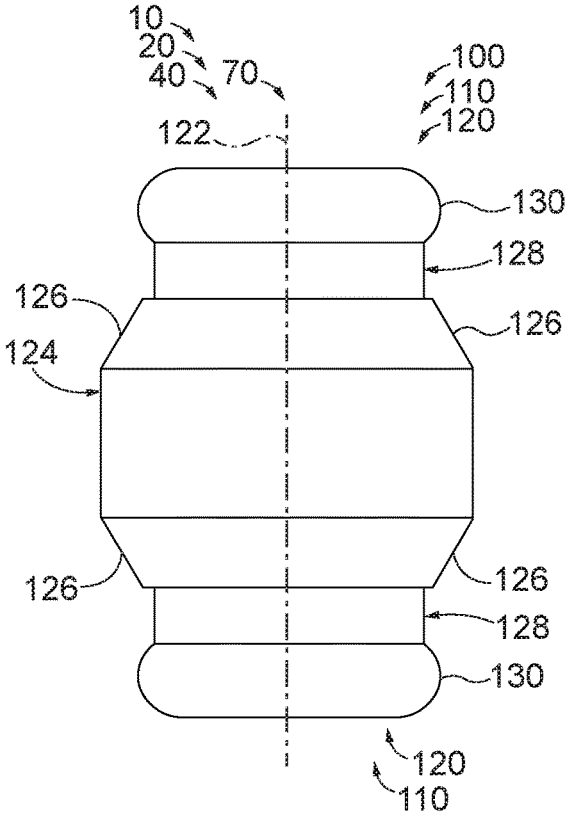
FIG. 23 is a side elevation view illustrating an example of a toy construction piece in the form of a double male piece according to the present disclosure.
Figure 32:
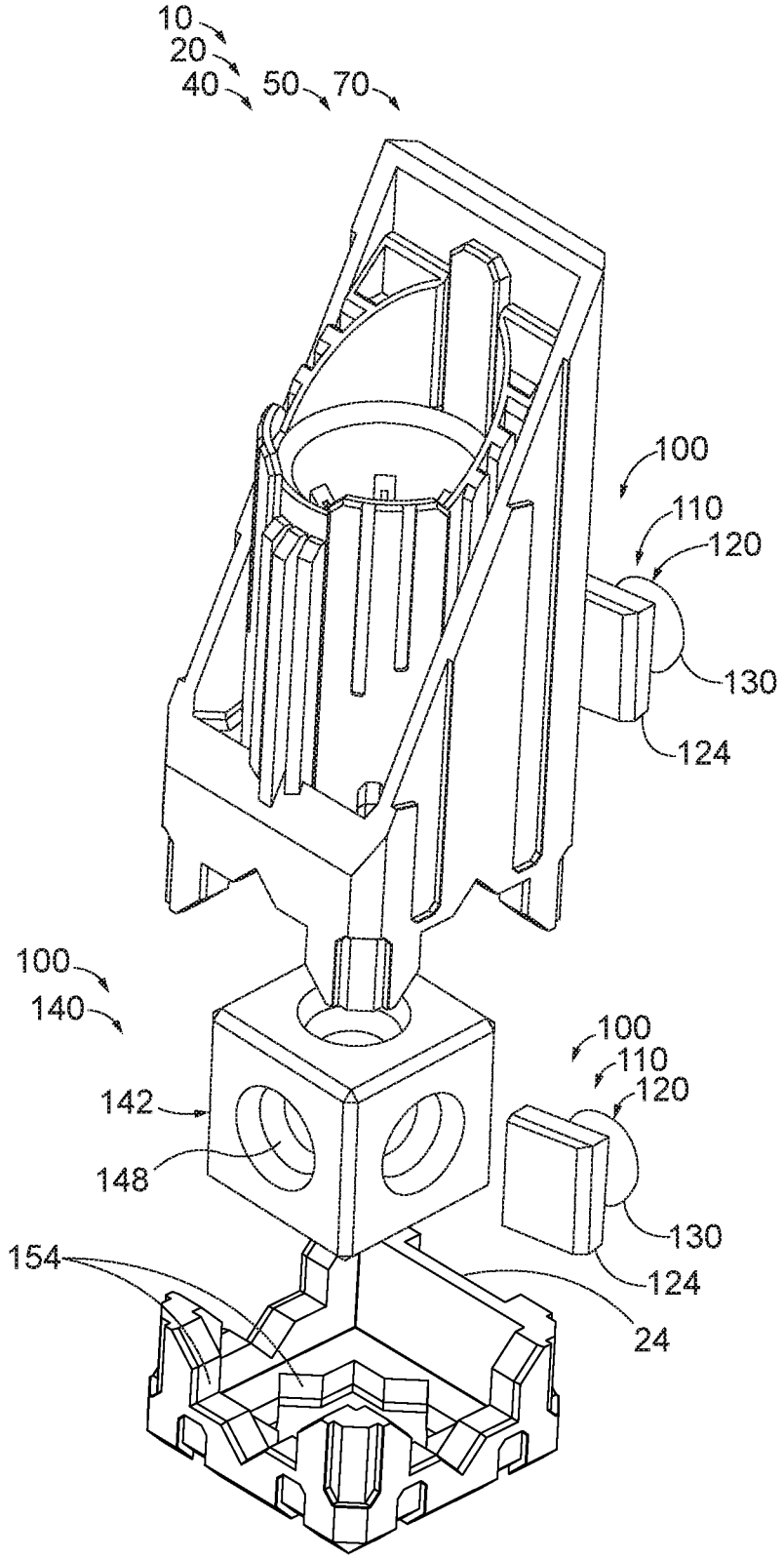
FIG. 32 is an exploded top side isometric view illustrating an example of a structural block that also is a detail piece according to the present disclosure.
Figure 33:
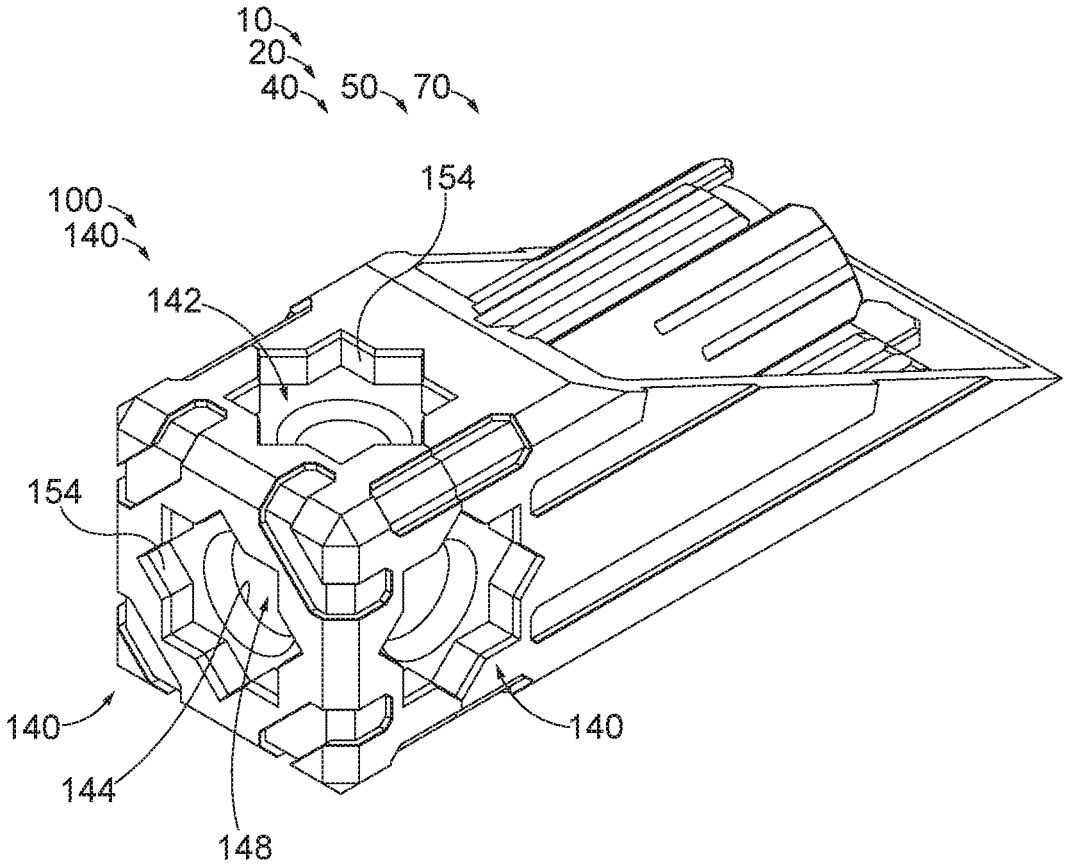
FIG. 33 is a rear top side isometric view illustrating the structural block of FIG. 32 in an assembled configuration.

As still another example, toy construction piece 20 may include and/or be a double male piece 70 that includes two instances of male connection element 110. In this manner, double male piece 70 also may be described as a more specific example of structural block 40. Double male piece 70 may be described as including a first instance of male connection element 110 with a first connector peg 128 extending along a first peg axis 122 and a second instance of male connection element 110 with a second connector peg 128 extending along a second peg axis 122. In such an example, the first peg axis may be parallel to and/or collinear with the second peg axis. As a more specific example, when the first peg axis is collinear with the second peg axis, double male piece 70 may be utilized to selectively couple two other toy construction pieces 20 to one another such that female connection elements 140 of each toy construction piece are adjacent and/or abutting. Alternatively, the first peg axis and the second peg axis may be oblique and/or perpendicular. As another example, the first peg axis and the second peg axis may be non-intersecting. Examples of double male piece 70 are illustrated in FIGS. 23 and 32-33, as discussed below.

It is within the scope of the present disclosure that a given (i.e., a particular) toy construction piece 20 may include and/or be more than one of structural block 40, detail piece 50, terminal piece 60, and/or double male piece 70. As examples, a given toy construction piece 20 may represent an example of both structural block 40 and detail piece 50, or may represent an example of both detail piece 50 and terminal piece 60.

Figure 4:
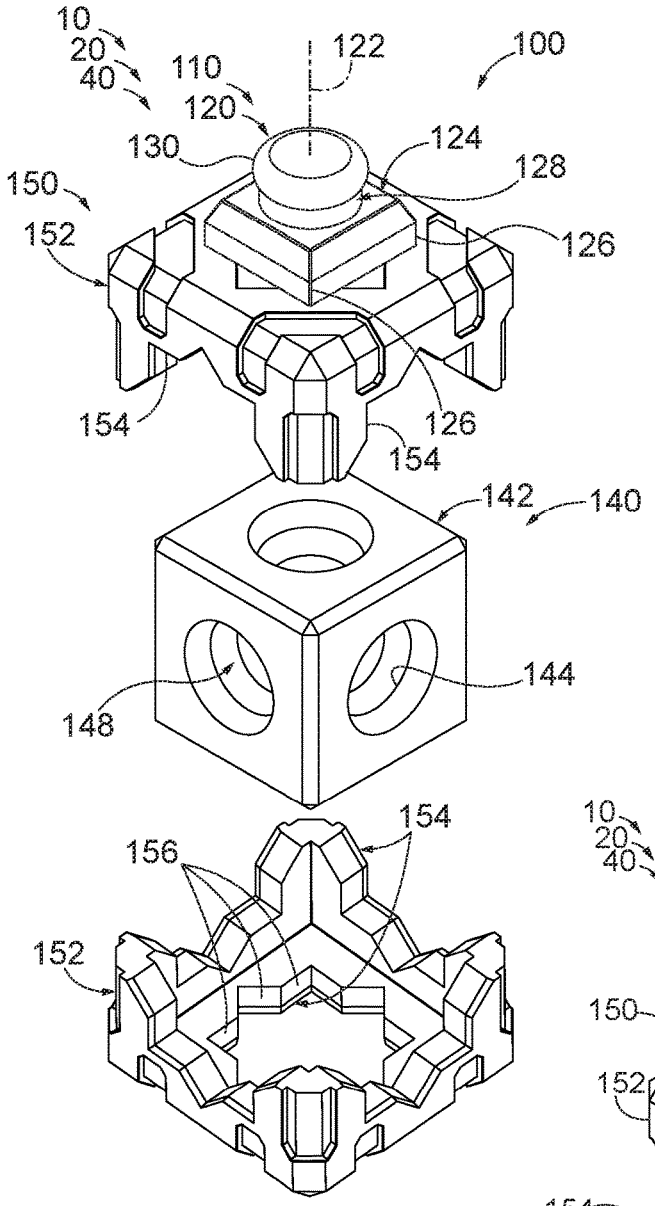
FIG. 4 is an exploded top side isometric view illustrating an example of a toy construction piece according to the present disclosure.
Figure 5:
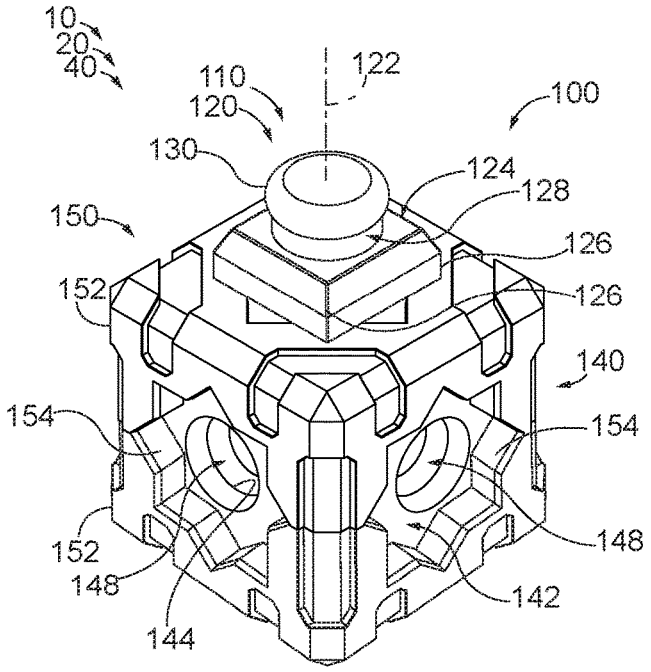
FIG. 5 is a top side isometric view illustrating the toy construction piece of FIG. 4 in an assembled configuration.

FIGS. 4-16 illustrate examples of structural blocks 40 and/or components thereof. Specifically, FIG. 4 is an exploded view of an example of structural block 40, while FIG. 5 illustrates the assembled structural block of FIG. 4. In the example of FIGS. 4-5, structural block 40 includes one instance of male connection element 110 and five instances of female connection element 140 (two of which are visible in FIG. 5). That is, in the example of FIGS. 4-5, structural block 40 includes a single peg unit 120 and a connector core 142 with five instances of receiver cavity 148. FIGS. 4-5 illustrate an example in which connector core 142 is received within two shell components 152 such that the connector core 142 is entirely contained within core shell 150 that consists of the two shell components.

Figure 6:
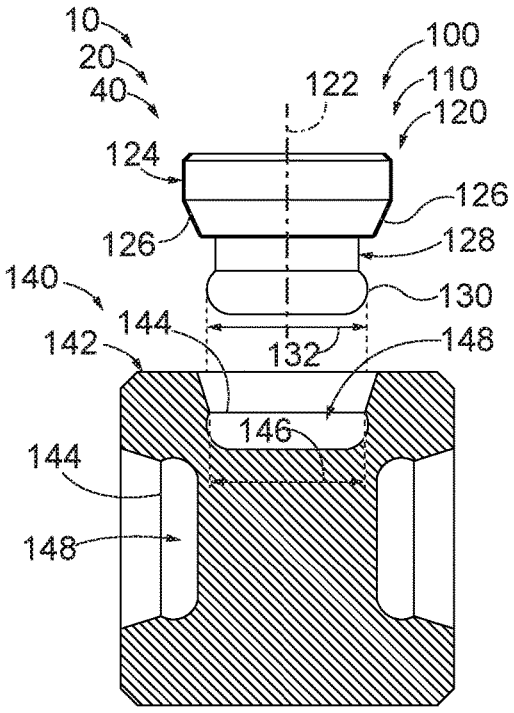
FIG. 6 is a cross-sectional side elevation view illustrating a connection system with a male connection element removed from a female connection element according to the present disclosure.
Figure 7:
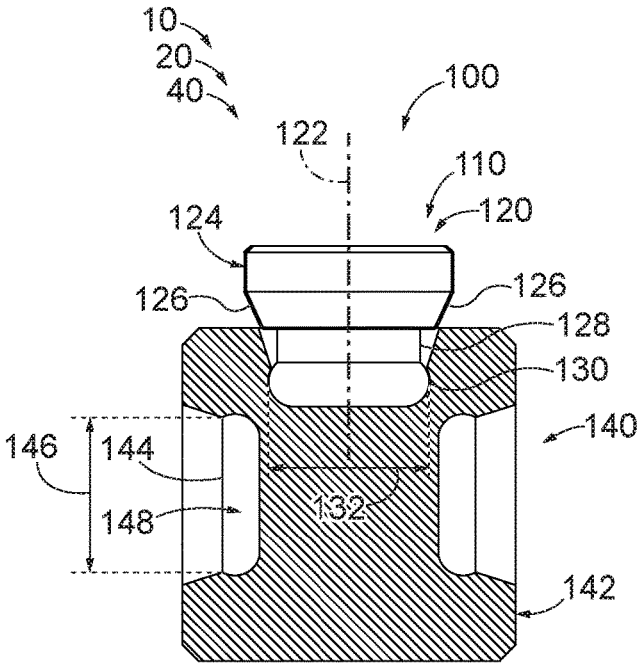
FIG. 7 is a cross-sectional side elevation view illustrating the connection system of FIG. 6 with the male connection element operatively coupled to the female connection element according to the present disclosure.
Figure 8:
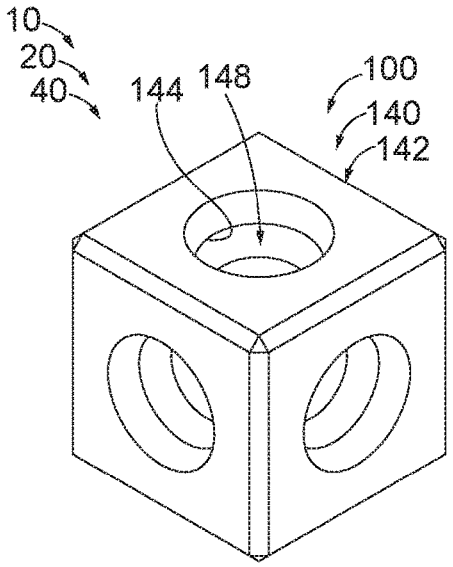
FIG. 8 is a front top side isometric view illustrating an example of a connector core according to the present disclosure.
Figure 9:
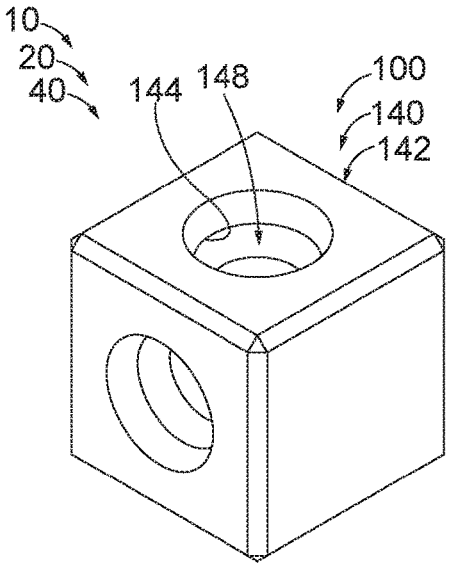
FIG. 9 is a rear top side isometric view illustrating the connector core of FIG. 8.
Figure 10:
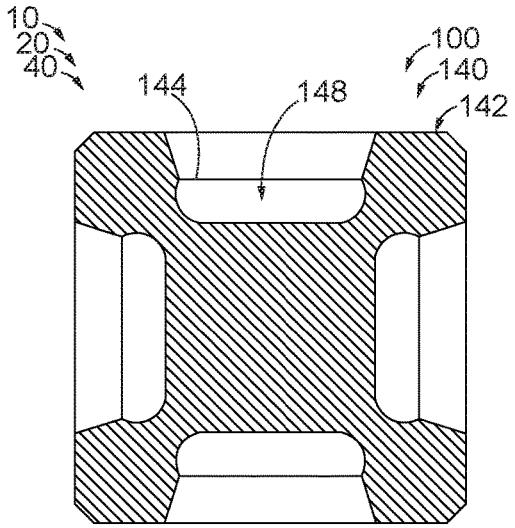
FIG. 10 is a cross-sectional side elevation view illustrating the connector core of FIGS. 8-9.
Figure 11:
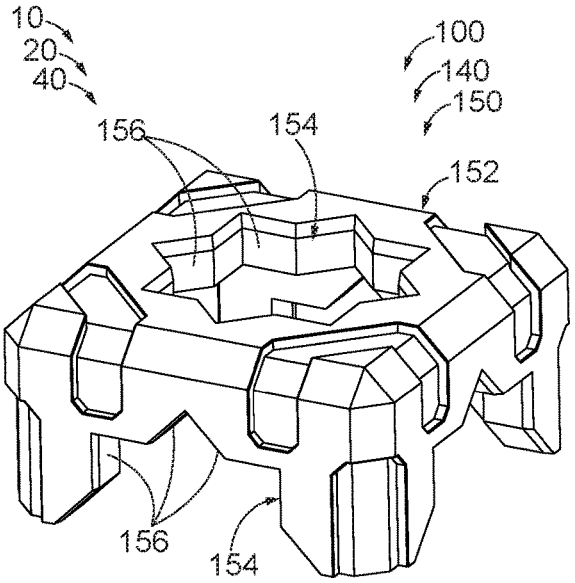
FIG. 11 is a top side isometric view illustrating an example of a shell component according to the present disclosure.

FIGS. 6-10 illustrate aspects of connector core 142 of the structural block 40 of FIGS. 4-5, while FIG. 11 illustrates another example of shell component 152 that may be utilized in conjunction with the connector core of FIGS. 4-10. Specifically, FIGS. 6-7 illustrate a peg unit 120 removed from connector core 142 (FIG. 6) and operatively coupled to the connector core (FIG. 7), while FIGS. 8-10 illustrate distinct views of the connector core. Connector core 142 is shown in cross-section in FIGS. 6-7 and 10. As illustrated in FIGS. 6-7, each receiver cavity 148 of connector core 142 is partially defined by a respective shoulder 144 with shoulder diameter 146 that is smaller than peg head diameter 132 of peg unit 120. Thus, when peg unit 120 is operatively coupled to connector core 142 (FIG. 7), peg head 130 is received within receiver cavity 148 and is partially restricted from removal from the receiver cavity via engagement with shoulder 144. FIG. 11 illustrates an example of shell component 152 that defines an alignment guide 154 with a chamfered surface. Specifically, alignment guide 154 of shell component 152 of FIG. 11 includes a perimeter with a chamfered edge, such as may facilitate receiving peg base 124 therein.

As discussed, FIGS. 4-11 illustrate an example of structural block 40 (and/or components thereof) in the form of a cube that includes one instance of male connection element 110 and five instances of female connection element 140. However, it is additionally within the scope of the present disclosure that a structural block in the form of a cube may have any appropriate numbers of male connection elements and/or female connection elements. As an example, structural block 40 may be a cube that includes six instances of female connection element 140 and no (i.e., zero) instances of male connection element 110. Such an example may be similar in appearance to structural block 40 of FIGS. 4-11 but for the removal of peg unit 120 and the addition of receiver cavity 148 in its place. More specifically, such an example may utilize two instances of shell component 152 of FIG. 11 that collectively form core shell 150, with the core shell being assembled around a variant of connector core 142 of FIGS. 8-10 in which each face of the connector core includes an instance of receiver cavity 148.

Figure 12:
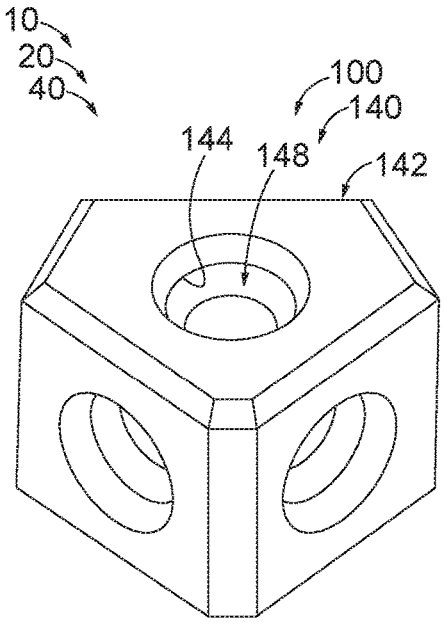
FIG. 12 is a front top side isometric view illustrating another example of a connector core according to the present disclosure.
Figure 13:
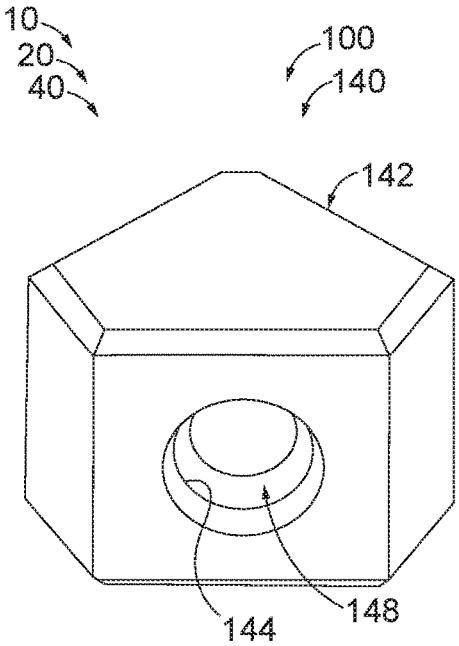
FIG. 13 is a rear bottom side isometric view illustrating the connector core of FIG. 12.
Figure 14:
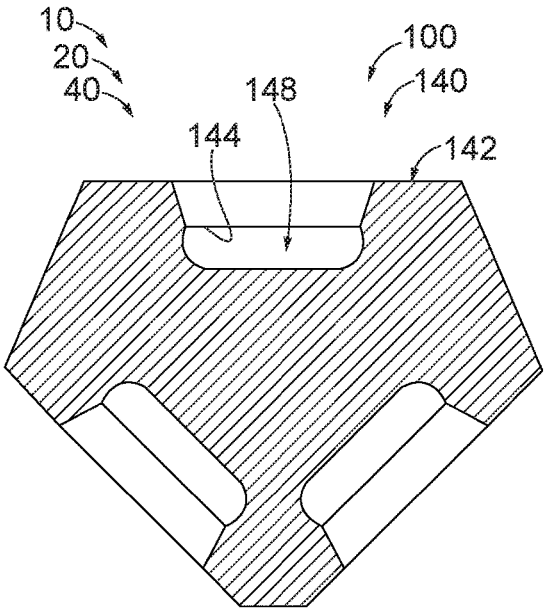
FIG. 14 is a cross-sectional top plan view illustrating the connector core of FIGS. 12-13.
Figure 15:
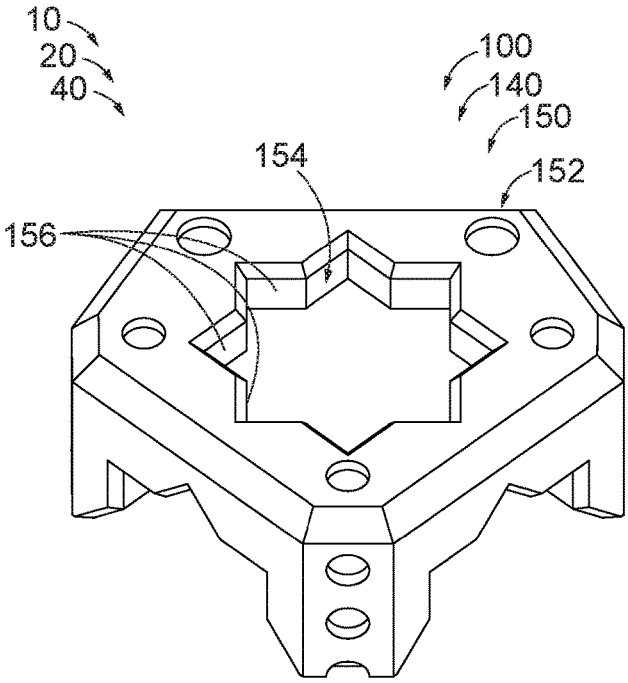
FIG. 15 is a front top side isometric view illustrating another example of a shell component according to the present disclosure.
Figure 16:
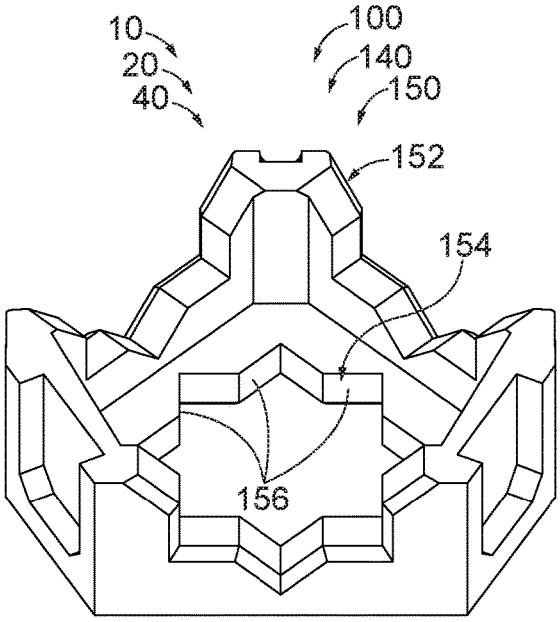
FIG. 16 is a rear bottom side isometric view illustrating the shell component of FIG. 15.

FIGS. 12-16 illustrate components of another example of structural block 40. Specifically, FIGS. 12-14 illustrate an example of connector core 142 that is generally in the shape of a pentagonal prism, while FIGS. 15-16 illustrate an example of shell component 152 that may be utilized in conjunction with the connector core of FIGS. 12-14. In this manner, an example of toy construction piece 20 and/or structural block 40 may include connector core 142 of FIGS. 12-14 operatively received within core shell 150 that includes two instances of shell component 152 of FIGS. 15-16 operatively coupled to one another. Connector core 142 of FIGS. 12-14 includes four receiver cavities 148, three of which are arranged in a generally triangular configuration. Thus, utilizing a structural block 40 that includes connector core 142 of FIGS. 12-14 may permit constructing along directions and/or dimensions that are not strictly orthogonal to one another. FIGS. 15-16 illustrate and example of shell component 152 that defines an alignment guide 154 with a chamfered surface. Specifically, alignment guide 154 of shell component 152 of FIGS. 15-16 includes a perimeter with a chamfered edge, such as may facilitate receiving peg base 124 therein.

Figure 17:
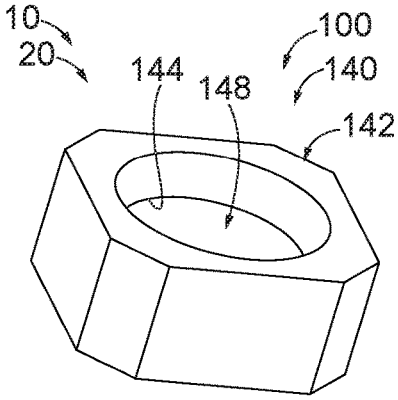
FIG. 17 is a top side isometric view illustrating another example of a connector core according to the present disclosure.

FIG. 17 illustrates yet another example of connector core 142, while FIGS. 18-21 illustrate examples of toy construction pieces 20 and/or components thereof that may include and/or be utilized in conjunction with the connector core of FIG. 17. The example of connector core 142 of FIG. 17 includes female connection element 140 with a single receiver cavity 148. Thus, the connector core 142 of FIG. 17 may be smaller than an example of connector core 142 that includes a greater number of receiver cavities 148, such as may permit the connector core of FIG. 17 to be incorporated into toy construction pieces 20 that are relatively small and/or to occupy a relatively small proportion of the toy construction piece.

Figure 18:
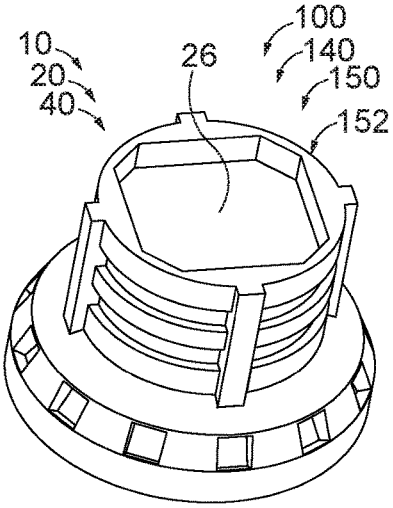
FIG. 18 is a top side isometric view illustrating a toy construction piece with a connector core receiver according to the present disclosure.
Figure 19:
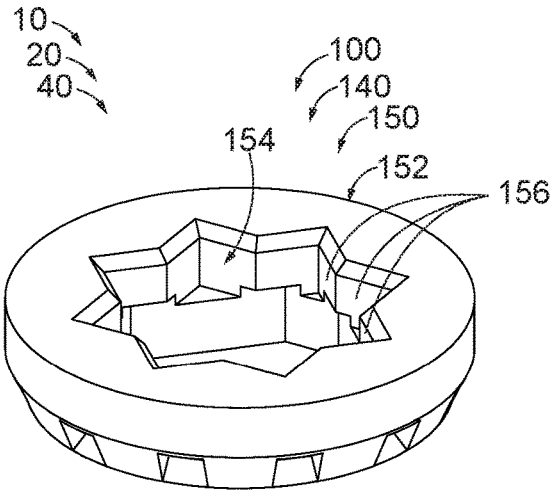
FIG. 19 is a top side isometric view illustrating another example of a shell component according to the present disclosure.
Figure 20:
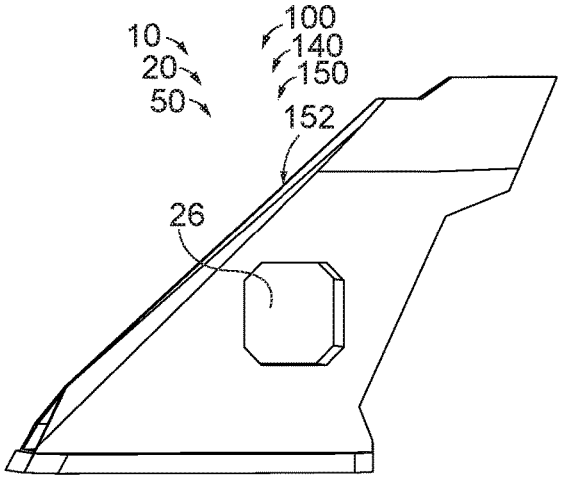
FIG. 20 is a side isometric view illustrating an example of a detail piece with a connector core receiver according to the present disclosure.
Figure 21:
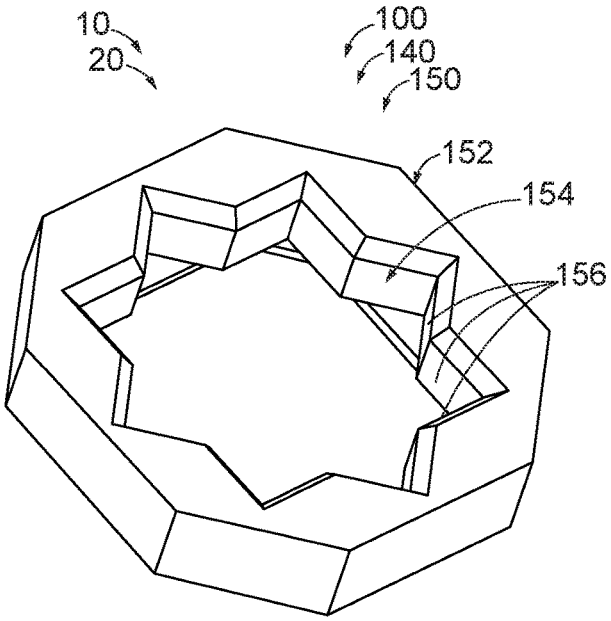
FIG. 21 is a top side isometric view illustrating another example of a shell component according to the present disclosure.

FIGS. 18-21 illustrate examples of components of toy construction pieces 20 that may incorporate the connector core 142 of FIG. 17. In such examples, and as illustrated in FIGS. 18 and 20, toy construction piece 20 may include a connector core receiver 26 configured to receive at least a portion of connector core 142, such as to conceal and/or cover the portion of the connector core received by the connector core receiver. In such examples, and as further illustrated in FIGS. 18 and 20, the portion of toy construction piece 20 that defines connector core receiver 26 may be described as including and/or being a shell component 152 of core shell 150. FIGS. 19 and 21 illustrate further examples of shell components 152, such as may be utilized in conjunction with the toy construction pieces 20 of FIGS. 18 and 20, respectively, and/or in conjunction with the connector core 142 of FIG. 17.

FIGS. 4-21 generally relate to examples in which connector core 142 is configured to be operatively, permanently, and/or non-removably coupled to a remainder of toy construction piece 20 to assemble the toy construction piece. However, this is not required of all examples of toy construction piece 20 that include connector core 142. For example, it is additionally within the scope of the present disclosure that connector core 142 may be integrally formed with a remainder of the toy construction piece. As another example, it is additionally within the scope of the present disclosure that connector core 142 may be configured to be selectively and repeatedly removed from and/or coupled to a remainder of toy construction piece 20.

Figure 22:
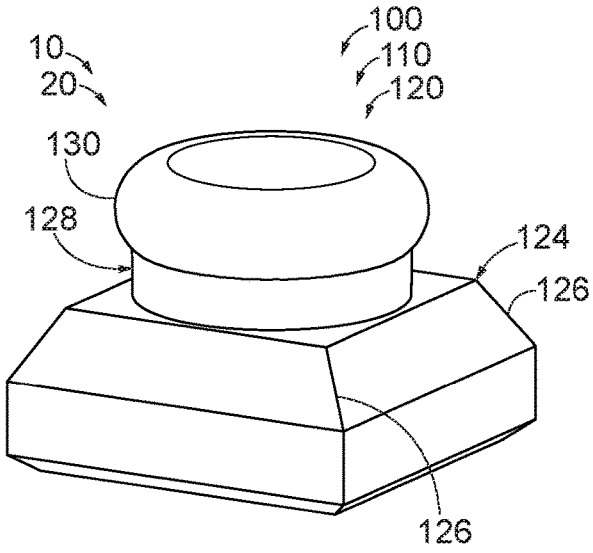
FIG. 22 is a top side isometric view illustrating an example of a peg unit according to the present disclosure.
Figure 24:
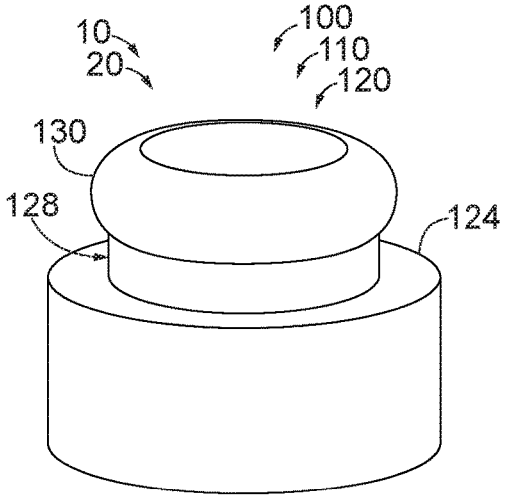
FIG. 24 is a top side isometric view illustrating another example of a peg unit according to the present disclosure.

FIGS. 22-24 illustrate examples of peg units 120 that may be included in male connection elements 110, and/or of toy construction pieces 20 including such peg units 120, according to the present disclosure. Specifically, FIG. 22 illustrates an example of peg unit 120 that includes a peg base 124 that is square and thus includes four corners 126. Additionally, peg base 124 of peg unit 120 of FIG. 22 includes a perimeter with a chamfered edge, such as may facilitate inserting the peg base into alignment guide 154 of female connection element 140. FIG. 23 illustrates an example of toy construction piece 20 in the form of double male piece 70 that includes two peg units 120, each peg unit 120 substantially similar to that of FIG. 22. That is, and as shown in FIG. 23, double male piece 70 of FIG. 23 includes two instances of male connection element 110, each with a respective connector peg 128 extending along a common peg axis 122. FIG. 24 illustrates an example of peg unit 120 that includes a peg base 124 that is cylindrical. Thus, a first construction piece 21 that incorporates the example of peg unit 120 of FIG. 24 may be free to rotate with respect to a second construction piece 22 when the peg unit operatively couples the first construction piece to the second construction piece.

Figure 25:
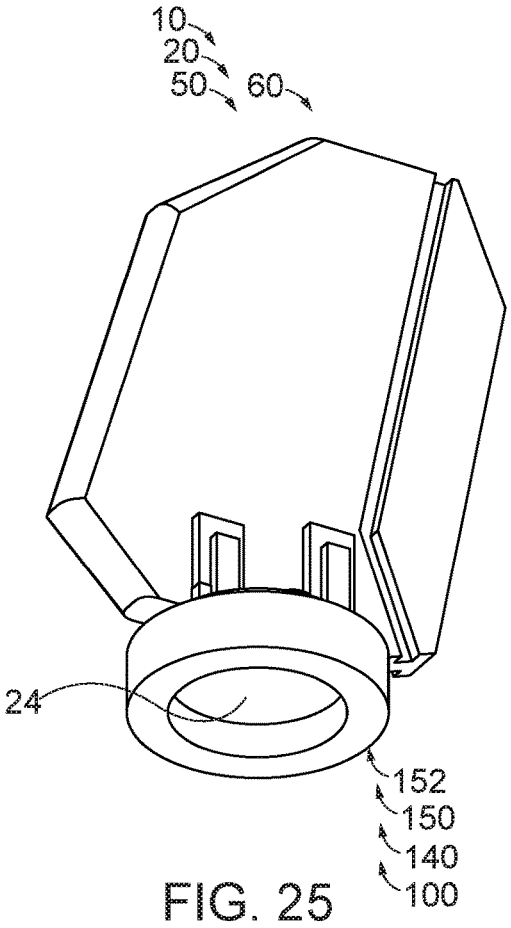
FIG. 25 is a bottom side isometric view illustrating an example of a detail piece with a peg base receiver according to the present disclosure.
Figure 26:
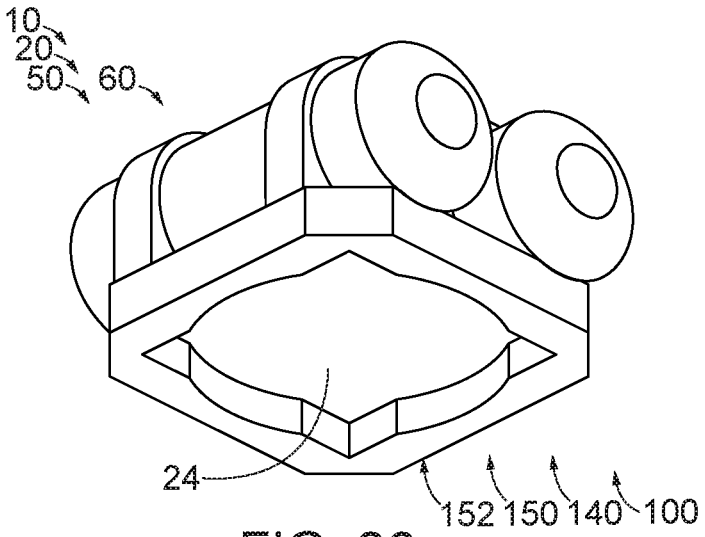
FIG. 26 is a bottom side isometric view illustrating another example of a detail piece with a peg base receiver according to the present disclosure.
Figure 27:
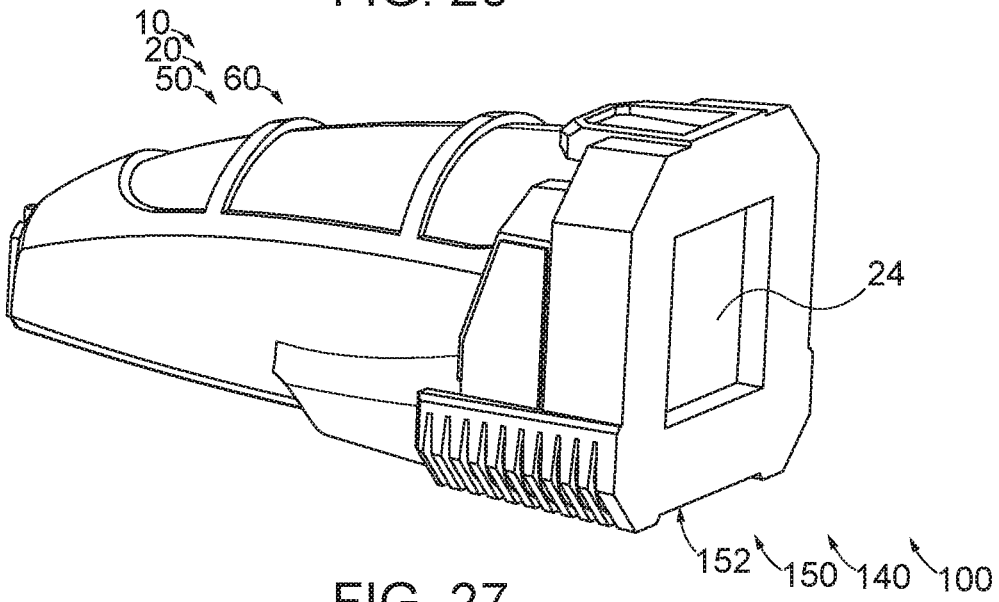
FIG. 27 is a top side isometric view illustrating another example of a detail piece with a peg base receiver according to the present disclosure.
Figure 28:
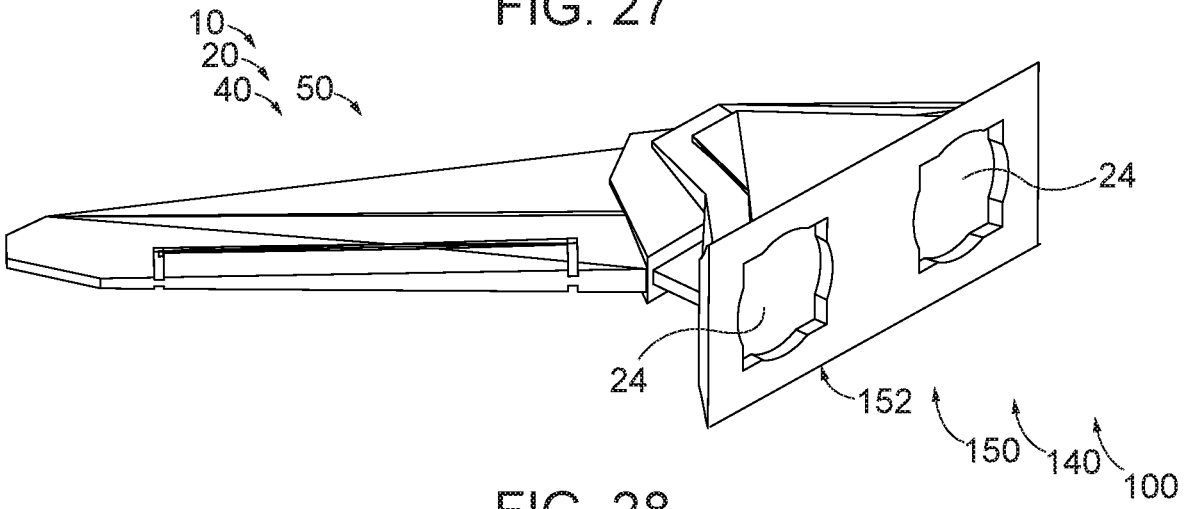
FIG. 28 is a top side isometric view illustrating an example of a detail piece with two peg base receivers according to the present disclosure.
Figure 29:
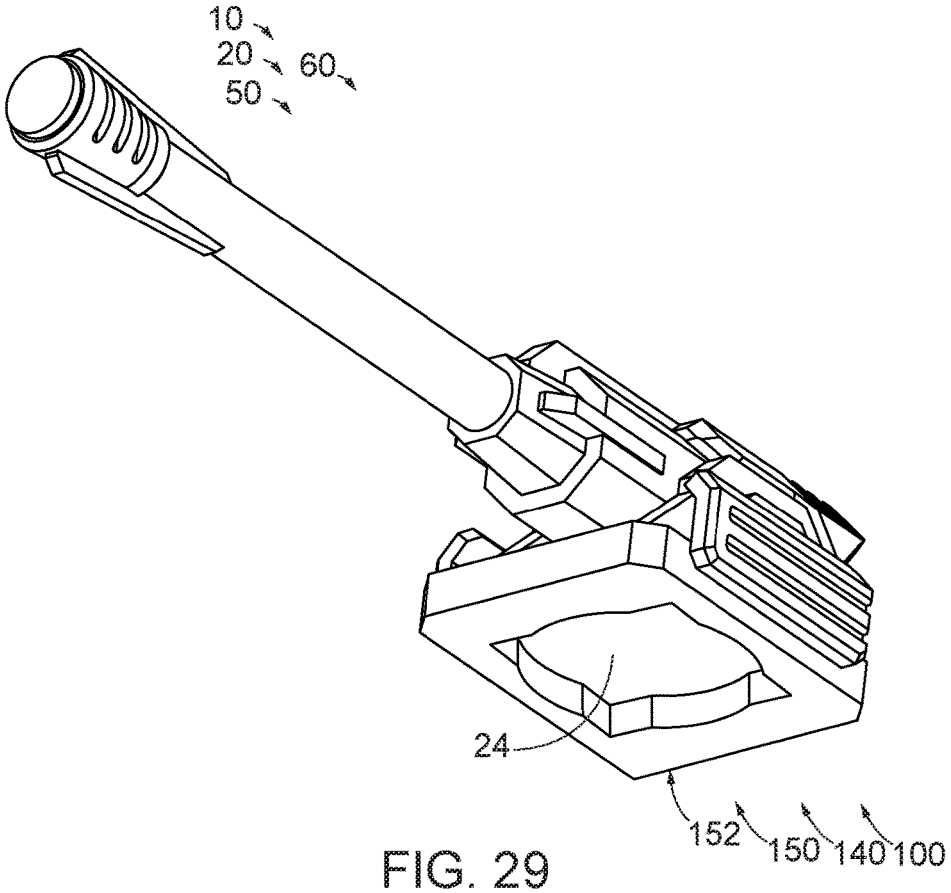
FIG. 29 is a bottom side isometric view illustrating another example of a detail piece with a peg base receiver according to the present disclosure.
Figure 30:
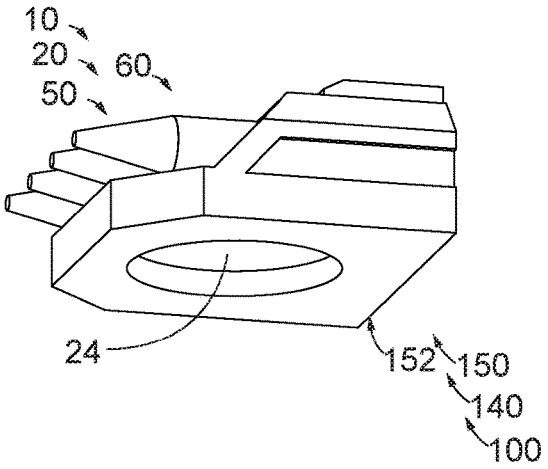
FIG. 30 is a bottom side isometric view illustrating another example of a detail piece with a peg base receiver according to the present disclosure.
Figure 31:
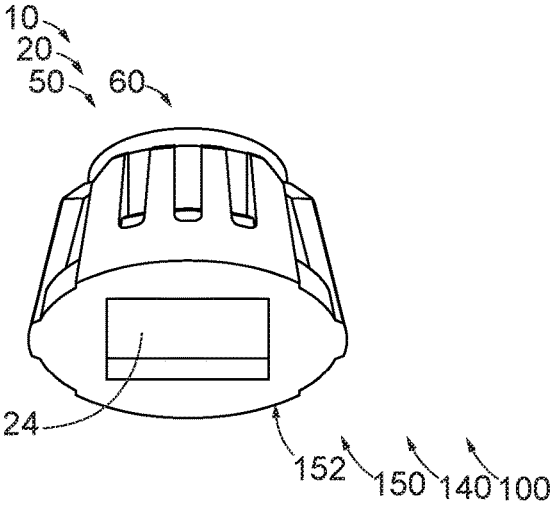
FIG. 31 is a bottom side isometric view illustrating another example of a detail piece with a peg base receiver according to the present disclosure.

FIGS. 25-31 illustrate examples of toy construction pieces 20 that are configured to integrate and/or be coupled to peg units 120, such as the peg units of FIGS. 22 and 24. Specifically, and as illustrated in FIGS. 25-31, a toy construction piece 20 may include a peg base receiver 24 configured to receive at least a portion of peg unit 120, such as at least a portion of peg base 124. Stated differently, each of FIGS. 25-31 illustrates an example of toy construction piece 20 that is configured to be coupled, such as permanently or non-removably coupled, to peg unit 120, such that the resulting toy construction piece includes male connection element 110. Peg base receiver 24 may have a shape that corresponds to a shape of peg base 124 of peg unit 120. For example, FIGS. 25 and 31 illustrate examples of peg base receiver 24 that are circular, such as may correspond to a shape and/or size of the cylindrical peg base 124 of peg unit 120 of FIG. 24. Additionally, FIGS. 26 and 28-29 illustrate examples of peg base receiver 24 that include each of a circular component and square-shaped component. In such examples, the circular component of each peg base receiver 24 may correspond to a shape and/or size of the cylindrical peg base 124 of peg unit 120 of FIG. 24. Additionally or alternatively, in such examples, the square-shaped component of each peg base receiver 24 may correspond to a shape and/or size of the square-shaped peg base 124 of peg unit 120 of FIG. 22.

Each of FIGS. 25-31 illustrates an example of toy construction piece 20 that also is a detail piece 50. Additionally, each of FIGS. 25-27 and 29-31 illustrates an example of toy construction piece 20 that also is a terminal piece 60 when peg unit 120 is operatively coupled to the toy construction piece. By contrast, FIG. 28 illustrates an example of toy construction piece 20 with two peg base receivers 24 such that the toy construction piece is configured to be operatively coupled to two peg units 120, and such that the resulting toy construction piece also may be described as a structural block 40 and/or as a double male piece 70.

FIGS. 22 and 24-31 generally relate to examples in which peg unit 120 is configured to be operatively, permanently, and/or non-removably coupled to a remainder of toy construction piece 20 to assemble the toy construction piece. However, this is not required of all examples of toy construction piece 20 that include peg units 120. For example, it is additionally within the scope of the present disclosure that peg unit 120 may be integrally formed with a remainder of the toy construction piece. As another example, it is additionally within the scope of the present disclosure that peg unit 120 may be configured to be selectively and repeatedly removed from and/or coupled to a remainder of toy construction piece 20.

FIGS. 32-33 illustrate another example of a toy construction piece 20. Specifically, FIG. 32 illustrates the toy construction piece in an exploded view, while FIG. 33 illustrates the assembled toy construction piece. FIGS. 32-33 illustrate an example of toy construction piece 20 that includes two peg units 120 (visible in FIG. 32) and a connector core 142 with four receiver cavities 148 that are accessible when the toy construction piece is assembled (two of which are visible in FIG. 32, and three of which are visible in FIG. 33). The example of toy construction piece 20 of FIGS. 32-33 takes the form of an engine air intake. In this manner, the example of toy construction piece 20 of FIGS. 32-33 also may be described as an example of structural block 40 and/or as an example of detail piece 50, and further may be described as including two instances of male connection element 110 and four instances of female connection element 140. In this manner, the example of toy construction piece 20 of FIGS. 32-33 also may be described as an example of double male piece 70.

Figure 34:
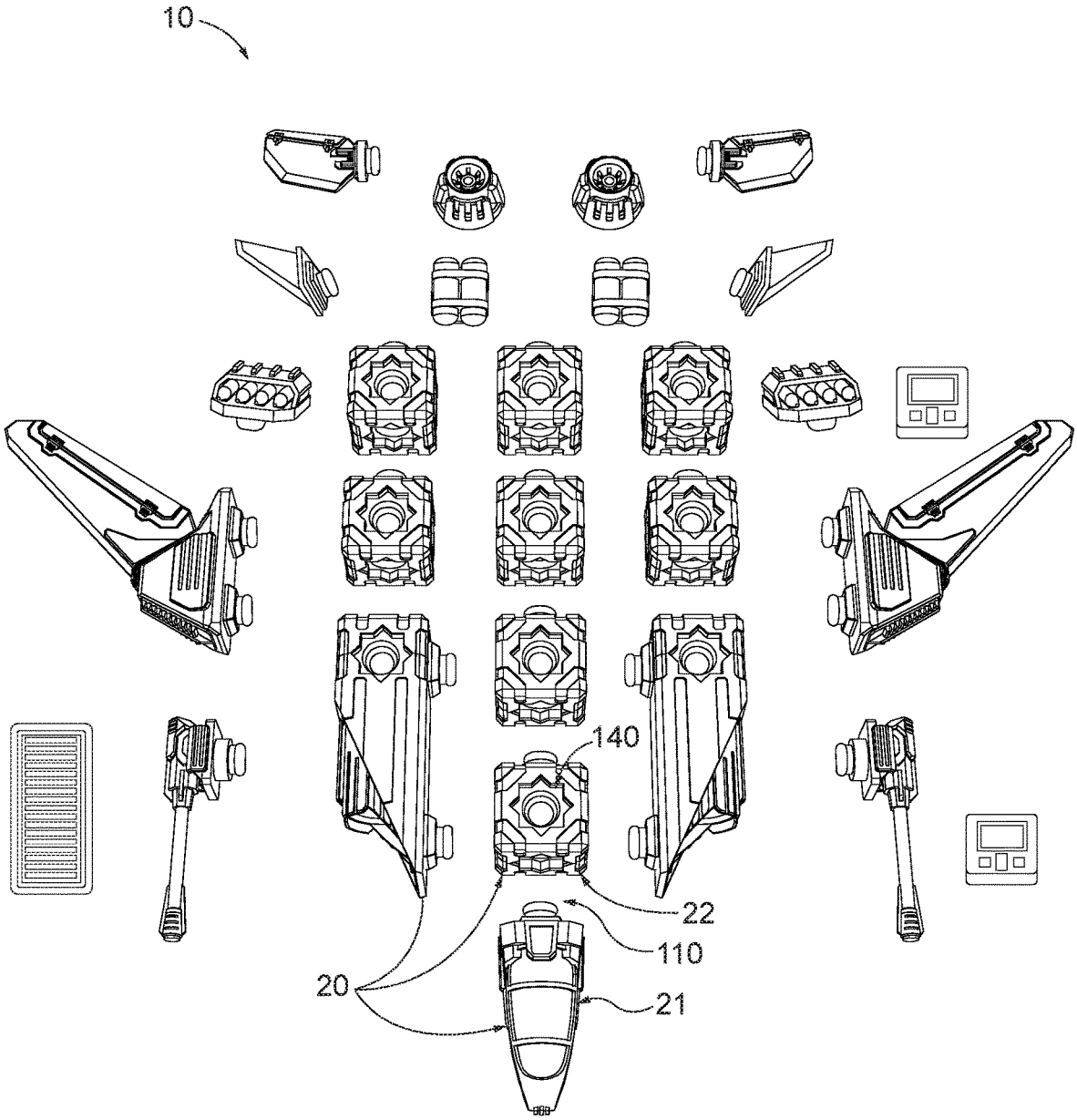
FIG. 34 is an exploded top perspective view illustrating an example of a toy construction kit according to the present disclosure.
Figure 35:
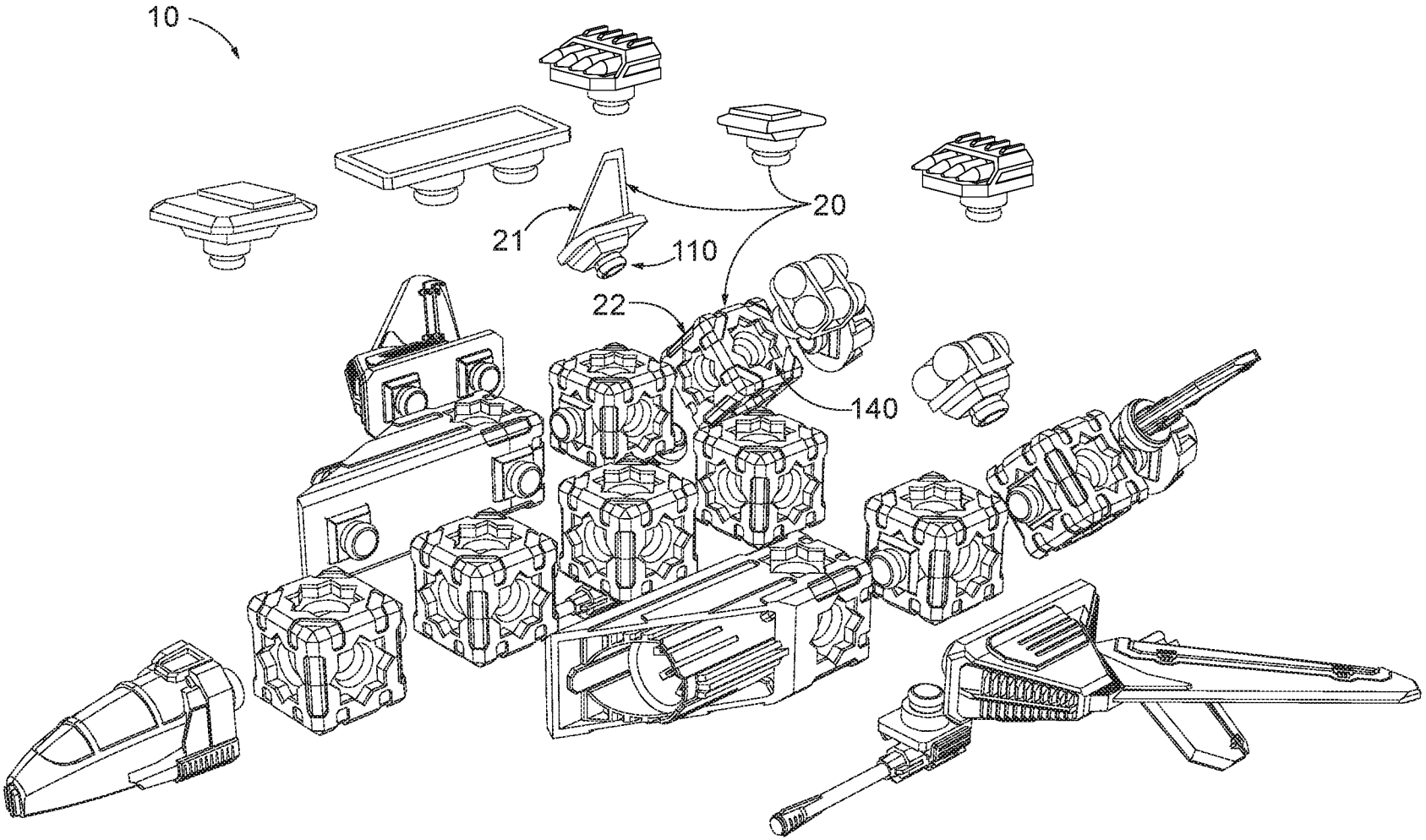
FIG. 35 is an exploded top side isometric view illustrating the toy construction kit of FIG. 34.
Figure 36:
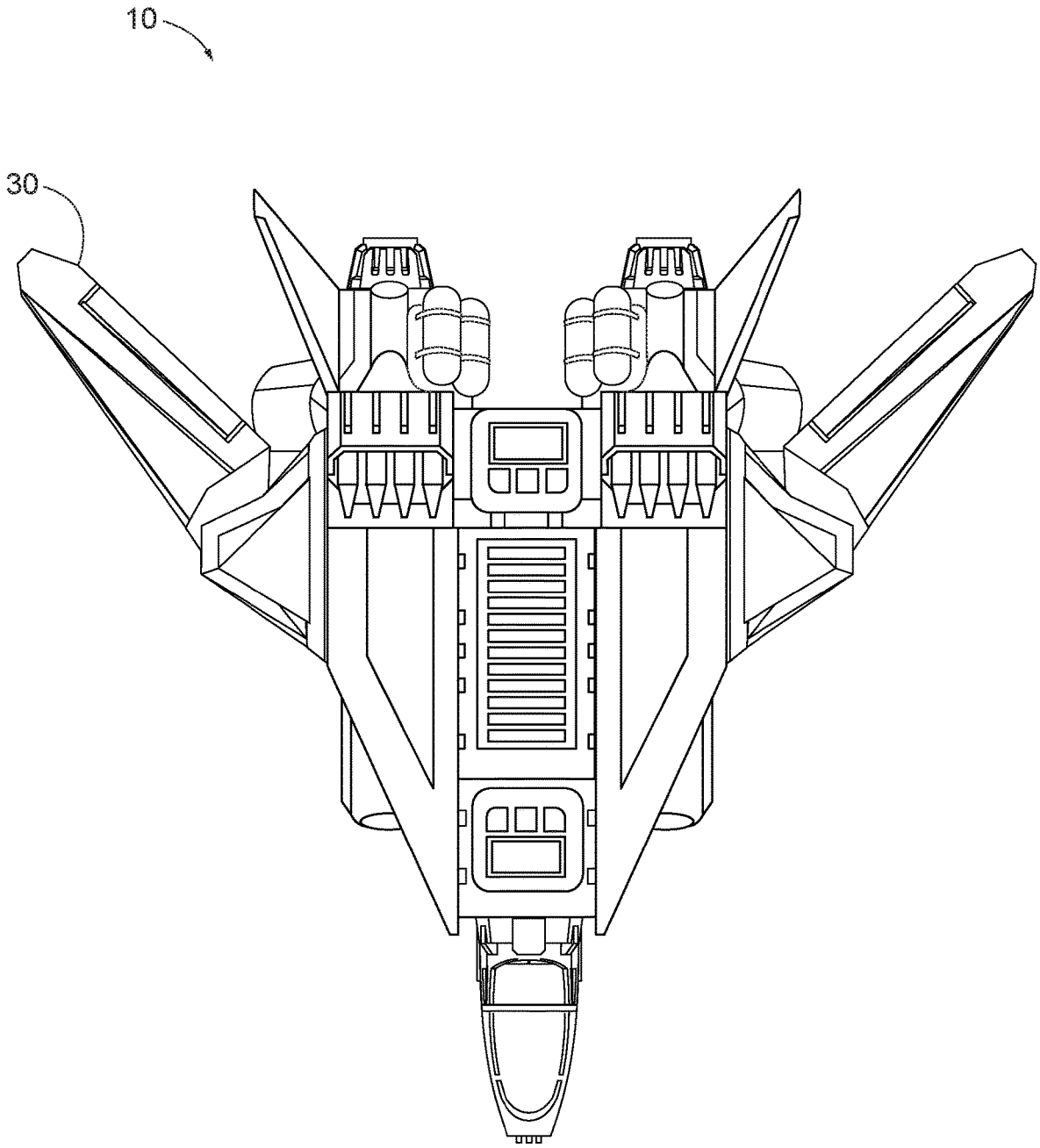
FIG. 36 is a top plan view illustrating an example of a constructed assembly according to the present disclosure formed with the toy construction kit of FIGS. 34-35.
Figure 37:
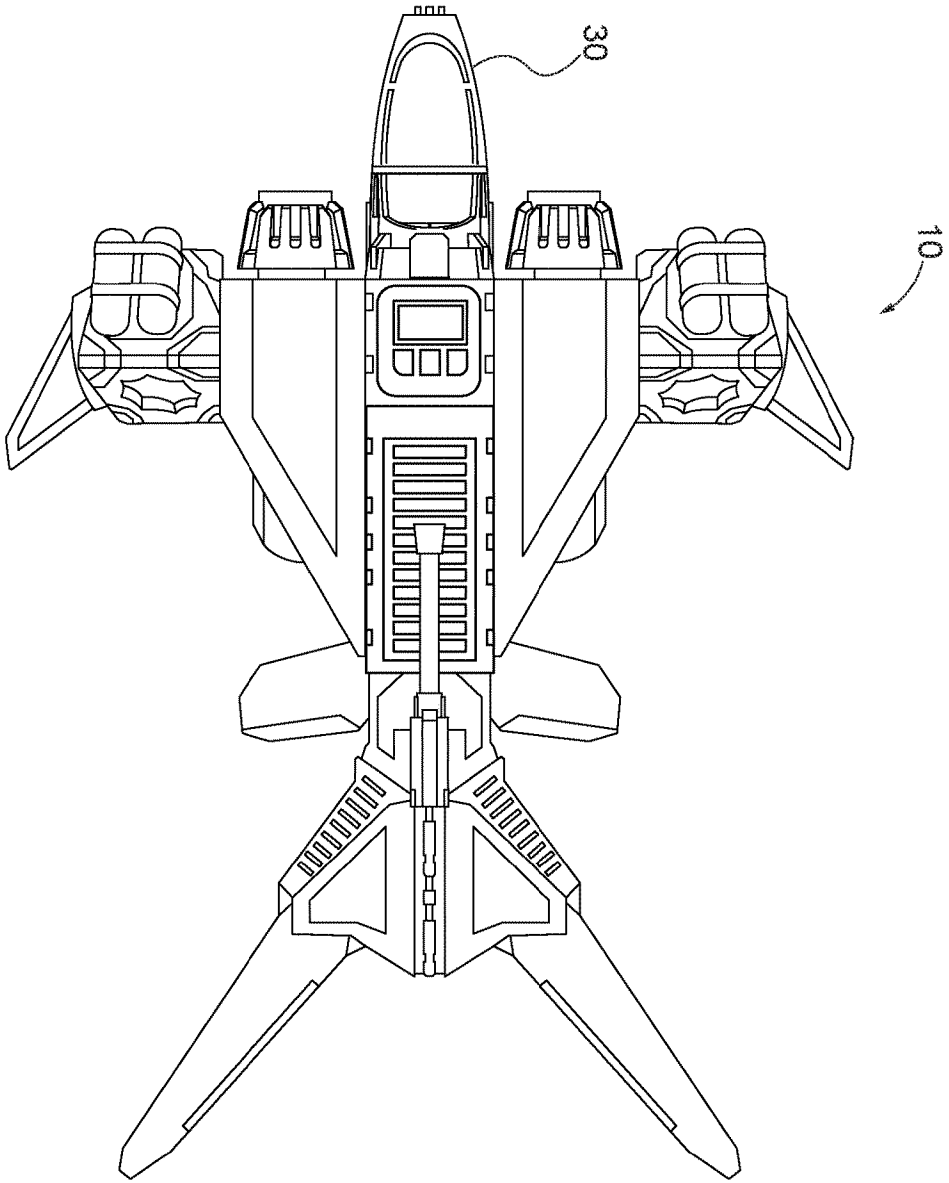
FIG. 37 is a top plan view illustrating another example of a constructed assembly formed with the toy construction kit of FIGS. 34-35.

As discussed, FIGS. 34-37 illustrate examples of toy construction kit 10. Specifically, FIGS. 34-35 illustrate the plurality of toy construction pieces 20 of toy construction kit 10 arranged in a configuration corresponding to an example of constructed assembly 30, while FIG. 36 illustrates the assembled constructed assembly. FIG. 37 illustrates another example of constructed assembly 30 that may be constructed from the plurality of toy construction pieces 20 of the toy construction kit 10 of FIGS. 34-35. Stated differently, FIGS. 36-37 collectively illustrate a plurality of distinct constructed assemblies 30 that may be constructed from a given set of toy construction pieces 20 associated with a given toy construction kit 10.

Each toy construction piece 20 of toy construction kit 10 may have any appropriate size. As examples, each toy construction piece 20 may have a characteristic size, which is equal to a side length of a smallest cube that can circumscribe the toy construction piece, such that the characteristic size is at least 10 millimeters (mm), at least 20 mm, at least 30 mm, at least 40 mm, at least 50 mm, at least 100 mm, at most 150 mm, at most 70 mm, at most 45 mm, at most 35 mm, at most 25 mm, and/or at most 15 mm. Additionally, toy construction kit 10 may include any appropriate number of toy construction pieces 20. As examples, toy construction kit 10 may include at least 5 toy construction pieces, at least 10 toy construction pieces, at least 50 toy construction pieces, at least 100 toy construction pieces, at least 500 toy construction pieces, at least 1,000 toy construction pieces, at least 5,000 toy construction pieces, at most 10,000 toy construction pieces, at most 2,000 toy construction pieces, at most 700 toy construction pieces, at most 200 toy construction pieces, at most 70 toy construction pieces, at most 20 toy construction pieces, and/or at most 7 toy construction pieces.

While the present disclosure generally is directed to toy construction kits 10 with toy construction pieces 20 that are operatively coupled and/or assembled via connection system 100, it is additionally within the scope of the present disclosure that toy construction pieces 20 additionally or alternatively may be joined via other structures and/or mechanisms. That is, while toy construction kits 10 according to the present disclosure generally utilize at least one instance of connection system 100 to operatively couple toy construction pieces 20 to one another, such toy construction kits also may utilize additional coupling mechanisms, such as adhesive, magnetic, and/or mechanical coupling mechanisms, without departing from the scope of the present disclosure.

In some examples, toy construction kit 10 and/or constructed assembly 30 is configured to be utilized in conjunction with an augmented reality play system. As an example of such functionality, a user may direct a camera of an electronic device (such as a computer, a tablet computer, a mobile phone, a smart phone, and/or a virtual reality headset) at constructed assembly 30, and a display screen of the electronic device may display an artificially augmented version and/or rendering of the constructed assembly. As examples, the display screen may display constructed assembly 30 with colors, textures, and/or component animations that are not present in the actual constructed assembly. As more specific examples, the display screen may display animations of functions corresponding to one or more detail pieces 50, such as guns firing, missiles firing, lights illuminating, aerodynamic control surfaces actuating, engines operating, components sustaining damage, etc. In such an example, the augmented reality play system may operate in any appropriate manner. For example, the augmented reality play system may be configured to detect and/or recognize the structure of constructed assembly 30, even when the constructed assembly is arbitrarily custom-built by the user, such as via visual identification of the toy construction pieces 20 that form the constructed assembly. Additionally or alternatively, one or more toy construction pieces 20 may include a marker that serves as a reference point for locating and/or identifying the toy construction pieces. Identification of the form and/or structure of constructed assembly 30 may be performed locally on the electronic device and/or may be performed by a processing unit that is removed from the electronic device. In some examples, the augmented reality play system may be configured to display the artificially augmented version and/or rendering of the constructed assembly based upon a virtual model that represents the constructed assembly, such as may be electronically constructed (e.g., via a Web site and/or software program) and/or uploaded by a user. In some examples, the augmented reality play system may be configured to display the artificially augmented version and/or rendering of the constructed assembly such that the artificially augmented version and/or rendering appears to be larger or smaller than the corresponding constructed assembly, such as to portray a "life size" version of the constructed assembly.

Toy construction kit 10 additionally or alternatively may be configured to be utilized in conjunction with a digital building system. For example, the digital building system may employ and/or correspond to a Web site, personal computer application, and/or mobile electronic device application for use by the user. The digital building system may be utilized to digitally track each toy construction piece 20 owned by the user, such as to provide the user with an inventory of the toy construction pieces. The digital building system also may include and/or provide access to a catalog of constructed assemblies 30, such as a set of constructed assemblies that may be constructed from a given set of toy construction pieces 20. In this manner, a user may save a given constructed assembly 30 to the catalog; view additional constructed assemblies (such as may be produced by other users); view a set of constructed assemblies that may be assembled with the toy construction pieces owned by the user; view a list of toy construction pieces that the user would need to acquire in order to assemble a given constructed assembly; view instructions for assembling a given constructed assembly; etc.

Examples of connection systems for toy construction pieces, toy construction pieces including the same, and toy construction kits including the same according to the present disclosure are described in the following enumerated paragraphs:

A1. A connection system for toy construction pieces, comprising:

a male connection element including a peg unit with a connector peg that extends along a peg axis; and a female connection element, including:

at least a portion of a connector core that defines a receiver cavity; and at least a portion of a core shell that extends on an exterior side of the connector core;

wherein the receiver cavity is configured to selectively and repeatedly receive at least a portion of the connector peg to selectively and repeatedly couple the male connection element and the female connection element to one another; and wherein the connector peg is configured to be selectively and repeatedly removed from the receiver cavity to selectively and repeatedly uncouple the male connection element and the female connection element.

A2. The connection system of paragraph A1, wherein the connector core is formed of a material that is more resilient than the core shell.

A3. The connection system of any of paragraphs A1-A2, wherein the connector core and the core shell are formed of the same material.

A4. The connection system of any of paragraphs A1-A3, wherein at least a portion of the connector core is formed of a material that is different than a material that forms at least a portion of the connector peg.

A4.1. The connection system of paragraph A4, wherein:

(i) at least a portion of the connector core is formed of a material that is more resilient than at least a portion of the connector peg; or (ii) at least a portion of the connector peg is formed of a material that is more resilient than at least a portion of the connector core.

A4.2. The connection system of any of paragraphs A1-A4.1, wherein at least a portion of the connector core and at least a portion of the connector peg each are formed of a material that is more resilient than the core shell.

A5. The connection system of any of paragraphs A1-A4.1, wherein the core shell is formed of the same material as the connector peg.

A6. The connection system of any of paragraphs A1-A5, wherein the connector core is formed of at least one of a plastic, a polymer, a rubberized plastic, a vinyl plastic, and a thermoplastic elastomer (TPE).

A7. The connection system of any of paragraphs A1-A6, wherein one or both of the connector peg and the core shell is formed of at least one of a plastic, a polymer, a thermoplastic polymer, acrylonitrile butadiene styrene (ABS), a metal, and a die-cast metal.

A8. The connection system of any of paragraphs A1-A7, wherein the connector core and the core shell are different colors.

A9. The connection system of any of paragraphs A1-A8, wherein the core shell is formed of a material that is configured to be painted by a user.

A10. The connection system of any of paragraphs A1-A9, wherein the core shell includes a plurality of shell components that are operatively coupled to one another to assemble the core shell.

A11. The connection system of paragraph A10, wherein the plurality of shell components are adhered together to assemble the core shell.

A12. The connection system of any of paragraphs A10-A11, wherein the plurality of shell components are operatively coupled in a snap-fit engagement to assemble the core shell.

A13. The connection system of any of paragraphs A10-A12, wherein the connector core is positioned between the shell components to assemble the female connection element.

A14. The connection system of any of paragraphs A1-A13, wherein the connector core is integrally formed with the core shell, optionally via an overmolding process.

A15. The connection system of any of paragraphs A1-A14, wherein the core shell substantially covers the connector core.

A16. The connection system of paragraph A15, wherein the connector core is entirely contained within the core shell.

A17. The connection system of any of paragraphs A1-A16, wherein the connector core defines a plurality of receiver cavities, wherein the receiver cavity is a first receiver cavity of the plurality of receiver cavities, and wherein the plurality of receiver cavities includes one of two receiver cavities, three receiver cavities, four receiver cavities, five receiver cavities, six receiver cavities, and more than six receiver cavities.

A18. The connection system of any of paragraphs A1-A17, wherein the receiver cavity is configured to receive the connector peg in a friction-fit engagement.

A19. The connection system of any of paragraphs A1-A18, wherein the receiver cavity is configured to receive the connector peg in a snap-fit engagement.

A20. The connection system of any of paragraphs A1-A19, wherein the connector peg includes a peg head with a peg head diameter, as measured in a direction at least substantially perpendicular to the peg axis; wherein the connector core includes a shoulder that at least partially defines the receiver cavity; wherein the shoulder has a shoulder diameter; and wherein the peg head diameter is larger than the shoulder diameter.

A21. The connection system of paragraph A20, wherein the peg head extends around a full circumference of the connector peg.

A22. The connection system of any of paragraphs A20-A21, wherein the shoulder extends around a full perimeter of the receiver cavity.

A23. The connection system of any of paragraphs A20-A22, wherein at least one of the shoulder and the peg head is configured to resiliently deform to permit the peg head to pass into and out of the receiver cavity.

A24. The connection system of any of paragraphs A1-A23, wherein the peg unit additionally includes a peg base, and wherein the connector peg extends away from the peg base along the peg axis.

A25. The connection system of paragraph A24, wherein the female connection element includes an alignment guide that is defined by the core shell, and wherein the alignment guide receives at least a portion of the peg base when the male connection element is operatively coupled to the female connection element.

A26. The connection system of any of paragraphs A24-A25, wherein at least one of the peg base and a/the alignment guide includes a chamfered surface.

A27. The connection system of any of paragraphs A25-A26, wherein the alignment guide is aligned with the receiver cavity.

A28. The connection system of any of paragraphs A25-A27, wherein the alignment guide includes a plurality of alignment notches.

A29. The connection system of paragraph A28, wherein the plurality of alignment notches includes one of two alignment notches, three alignment notches, four alignment notches, five alignment notches, six alignment notches, seven alignment notches, eight alignment notches, and more than eight alignment notches.

A30. The connection system of any of paragraphs A28-A29, wherein the plurality of alignment notches includes four alignment notches that are arranged in a square pattern.

A31. The connection system of any of paragraphs A28-A30, wherein the plurality of alignment notches includes eight alignment notches that are arranged in a star-shaped pattern.

A32. The connection system of any of paragraphs A28-A31, wherein the peg base includes a plurality of corners, and wherein each corner of the plurality of corners is at least partially received within a corresponding alignment notch of the plurality of alignment notches when the male connection element is operatively coupled to the female connection element.

A33. The connection system of paragraph A32, wherein the plurality of alignment notches defines a plurality of discrete rotational orientations of the peg base relative to the alignment guide when the male connection element is operatively coupled to the female connection element.

A34. The connection system of any of paragraphs A32-A33, wherein, when the male connection element is operatively coupled to the female connection element, each corner of the plurality of corners engages the corresponding alignment notch to at least substantially restrict the male connection element from rotating relative to the female connection element about the peg axis.

A35. The connection system of any of paragraphs A32-A34, wherein the plurality of corners includes one of two corners, three corners, four corners, five corners, six corners, seven corners, eight corners, and more than eight corners.

A36. The connection system of any of paragraphs A32-A35, wherein the plurality of corners includes four corners that are arranged in a square pattern.

A37. The connection system of any of paragraphs A32-A36, wherein the plurality of corners includes eight corners that are arranged in a star-shaped pattern.

A38. The connection system of any of paragraphs A28-A37, wherein the peg base does not extend within any of the plurality of alignment notches when the male connection element is operatively coupled to the female connection element.

A39. The connection system of paragraph A38, wherein the male connection element is free to rotate with respect to the female connection element about the peg axis when the male connection element is operatively coupled to the female connection element.

B1. A toy construction kit, comprising:

a plurality of toy construction pieces that includes at least a first construction piece and a second construction piece; and at least one instance of the connection system of any of paragraphs A1-A38;

wherein the first construction piece includes the male connection element; wherein the second construction piece includes the female connection element; wherein the connection system is configured to selectively and repeatedly couple the first construction piece and the second construction piece to one another and to selectively and repeatedly uncouple the first construction piece and the second construction piece from one another; and wherein the toy construction kit is configured such that at least a subset of the plurality of toy construction pieces may be assembled to form at least one constructed assembly.

B2. The toy construction kit of paragraph B1, wherein the toy construction kit is configured such that the plurality of toy construction pieces may be assembled into each of a plurality of unique constructed assemblies.

B3. The toy construction kit of any of paragraphs B1-B2, wherein the constructed assembly takes the appearance of at least one of a vehicle, an aircraft, a spaceship, a machine, a robot, and a building.

B4. The toy construction kit of any of paragraphs B1-B3, wherein the peg unit is integrally formed with at least a portion of a remainder of the first construction piece.

B5. The toy construction kit of any of paragraphs B1-B3, wherein the peg unit is operatively coupled, and optionally non-removably coupled, to at least a portion of a remainder of the first construction piece.

B6. The toy construction kit of paragraph B5, wherein the first construction piece includes a peg base receiver configured to receive at least a portion of the peg unit to operatively couple the peg unit to the portion of the remainder of the first construction piece.

B7. The toy construction kit of any of paragraphs B1-B6, wherein the connector core is integrally formed with at least a portion of a remainder of the second construction piece.

B8. The toy construction kit of any of paragraphs B1-B6, wherein the connector core is operatively coupled, and optionally non-removably coupled, to at least a portion of a remainder of the second construction piece.

B9. The toy construction kit of paragraph B8, wherein the second construction piece includes a connector core receiver configured to receive at least a portion of the connector core to operatively couple the connector core to the portion of the remainder of the second construction piece.

B10. The toy construction kit of paragraph B9, wherein the connector core receiver conceals the portion of the connector core that is received within the connector core receiver.

B11. The toy construction kit of any of paragraphs B1-B10, wherein at least one toy construction piece of the plurality of toy construction pieces is a structural block that is configured to be selectively coupled to each of at least two other toy construction pieces of the plurality of toy construction pieces.

B12. The toy construction kit of paragraph B11, wherein the structural block includes at least one of:

(i) at least one instance of the male connection element; and (ii) at least one instance of the female connection element.

B13. The toy construction kit of any of paragraphs B11-B12, wherein the structural block is at least substantially concealed from view when the plurality of toy construction pieces are assembled into at least one constructed assembly of the plurality of constructed assemblies.

B14. The toy construction kit of any of paragraphs B11-B13, wherein the structural block is at least substantially in the shape of at least one of a cylinder, a polygonal prism, a triangular prism, a rectangular prism, a cube, a pentagonal prism, and a hexagonal prism.

B15. The toy construction kit of any of paragraphs B1-B14, wherein at least one toy construction piece of the plurality of toy construction pieces is a terminal piece that is configured to be selectively coupled to only one other toy construction piece of the plurality of toy construction pieces.

B16. The toy construction kit of paragraph B15, wherein the terminal piece includes one of the male connection element and the female connection element.

B17. The toy construction kit of any of paragraphs B1-B16, wherein at least one toy construction piece of the plurality of toy construction pieces is a detail piece that takes the appearance of a component of an outer surface of the constructed assembly.

B18. The toy construction kit of paragraph B17, wherein the detail piece takes the appearance of at least one of a passenger module, a cockpit, an engine, a jet engine, a rocket engine, a turbofan engine, an exhaust port, an aerodynamic surface, a wing, an aerodynamic stabilizer, a rudder, a fin, a weapon, a gun, a missile bank, a storage tank, a fuel tank, a communications device, an antenna, a satellite dish, a wheel, a humanoid arm, a humanoid leg, a humanoid head, a wall, a window, and a door B19. The toy construction kit of any of paragraphs B17-B18, wherein the detail piece is one of a/the structural block and a/the terminal piece.

B20. The toy construction kit of any of paragraphs B1-B19, wherein at least one toy construction piece of the plurality of toy construction pieces is a double male piece that includes two instances of the male connection element.

B21. The toy construction kit of paragraph B20, wherein the two instances of the male connection element include a first male connection element with a first connector peg extending along a first peg axis and a second male connection element with a second connector peg extending along a second peg axis.

B22. The toy construction kit of paragraph B21, wherein the first peg axis is parallel to the second peg axis.

B23. The toy construction kit of paragraph B22, wherein the first peg axis is collinear with the second peg axis.

B24. The toy construction kit of paragraph B21, wherein the first peg axis is at least one of oblique to and perpendicular to the second peg axis.

B25. The toy construction kit of any of paragraphs B21-B24, wherein the first peg axis and the second peg axis do not intersect.

B26. The toy construction kit of any of paragraphs B20-B25, wherein the double male piece is at least one of a/the structural block, a/the terminal piece, and a/the detail piece.

B27. The toy construction kit of any of paragraphs B1-B26, wherein each toy construction piece has a characteristic size, which is equal to a side length of a smallest cube that can circumscribe the toy construction piece, and wherein the characteristic size is at least one of at least 10 millimeters (mm), at least 20 mm, at least 30 mm, at least 40 mm, at least 50 mm, at least 100 mm, at most 150 mm, at most 70 mm, at most 45 mm, at most 35 mm, at most 25 mm, and at most 15 mm.

B28. The toy construction kit of any of paragraphs B1-B27, wherein the toy construction kit includes at least one of at least 5 toy construction pieces, at least 10 toy construction pieces, at least 50 toy construction pieces, at least 100 toy construction pieces, at least 500 toy construction pieces, at least 1,000 toy construction pieces, at least 5,000 toy construction pieces, at most 10,000 toy construction pieces, at most 2,000 toy construction pieces, at most 700 toy construction pieces, at most 200 toy construction pieces, at most 70 toy construction pieces, at most 20 toy construction pieces, and at most 7 toy construction pieces.

As used herein, the terms "selective" and "selectively," when modifying an action, movement, configuration, or other activity of one or more components or characteristics of an apparatus, mean that the specific action, movement, configuration, or other activity is a direct or indirect result of user manipulation of an aspect of, or one or more components of, the apparatus.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the term "at least substantially," when modifying a degree or relationship, includes not only the recited "substantial" degree or relationship, but also the full extent of the recited degree or relationship. A substantial amount of a recited degree or relationship may include at least 75% of the recited degree or relationship. For example, an object that is at least substantially formed from a material includes an object for which at least 75% of the object is formed from the material and also includes an object that is completely formed from the material. As another example, a first direction that is at least substantially parallel to a second direction includes a first direction that forms an angle with respect to the second direction that is at most 22.5 degrees and also includes a first direction that is exactly parallel to the second direction. As another example, a first length that is substantially equal to a second length includes a first length that is at least 75% of the second length, a first length that is equal to the second length, and a first length that exceeds the second length such that the second length is at least 75% of the first length.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, also are regarded as included within the subject matter of the inventions of the present disclosure.

The invention claimed is:

1. A toy construction kit, comprising:

a first toy construction piece including a male connection element; and a second toy construction piece including a connector core, a core shell that extends on an exterior side of the connector core, and a female connection element;

wherein the male connection element includes a peg unit with a connector peg that extends along a peg axis;

wherein the female connection element includes:

a connection element core portion of the connector core that defines a receiver cavity; and a connection element shell portion of the core shell;

wherein the receiver cavity is configured to selectively and repeatedly receive at least a portion of the connector peg to selectively and repeatedly couple the male connection element and the female connection element to one another to operatively couple the first toy construction piece with the second toy construction piece; wherein the connector peg is configured to be selectively and repeatedly removed from the receiver cavity to selectively and repeatedly uncouple the male connection element and the female connection element to selectively uncouple the first toy construction piece and the second toy construction piece from one another; wherein the connector core and the core shell are formed of different materials; wherein the connector core is formed of a material that is more resilient than the core shell; wherein the connector core and the connector peg are formed of different materials; and wherein the connector core is formed of a material that is more resilient than the connector peg; and wherein the connector peg includes a peg head with a peg head diameter, as measured in a direction at least substantially perpendicular to the peg axis; wherein the connection element core portion includes a shoulder that at least partially defines the receiver cavity; wherein the shoulder has a shoulder diameter; wherein the peg head diameter is larger than the shoulder diameter; and wherein at least one of the shoulder and the peg head is configured to resiliently deform to permit the peg head to pass into and out of the receiver cavity.

2. The toy construction kit of claim 1, wherein the shoulder is configured to resiliently deform to permit the peg head to pass into and out of the receiver cavity.

3. The toy construction kit of claim 2, wherein the shoulder is an annular constriction of the connection element core portion that extends around a full perimeter of an opening of the receiver cavity to partially define the receiver cavity.

4. The toy construction kit of claim 1, wherein the core shell substantially covers the connector core.

5. The toy construction kit of claim 1, wherein the peg unit additionally includes a peg base, wherein the connector peg extends away from the peg base along the peg axis, wherein the female connection element includes an alignment guide that is defined by the core shell, and wherein the alignment guide receives at least a portion of the peg base when the male connection element is operatively coupled to the female connection element.

6. The toy construction kit of claim 5, wherein the alignment guide includes a plurality of alignment notches, wherein the peg base includes a plurality of corners, and wherein each corner of the plurality of corners is at least partially received within a corresponding alignment notch of the plurality of alignment notches when the male connection element of the first toy construction piece is operatively coupled to the female connection element of the second toy construction piece.

7. The toy construction kit of claim 6, wherein the plurality of alignment notches defines a plurality of discrete rotational orientations of the peg base relative to the alignment guide when the male connection element of the first toy construction piece is operatively coupled to the female connection element of the second toy construction piece.

8. The toy construction kit of claim 5, wherein the alignment guide includes a plurality of alignment notches, wherein the peg base does not extend within any of the plurality of alignment notches when the male connection element of the first toy construction piece is operatively coupled to the female connection element of the second toy construction piece, and wherein the male connection element is free to rotate with respect to the female connection element about the peg axis when the male connection element of the first toy construction piece is operatively coupled to the female connection element of the second toy construction piece.

9. A toy construction kit, comprising:

a plurality of toy construction pieces;

wherein at least one toy construction piece of the plurality of toy construction pieces includes a male connection element that includes a peg unit with a connector peg that extends along a peg axis;

wherein at least one other toy construction piece of the plurality of toy construction pieces includes a female connection element that includes a connection element core portion and a connection element shell portion, wherein the connection element core portion defines a receiver cavity;

wherein each toy construction piece of the plurality of toy construction pieces that includes the female connection element additionally includes a connector core and a core shell such that the connection element core portion is at least a portion of the connector core and such that the connection element shell portion is at least a portion of the core shell; wherein the connection element core portion and the connection element shell portion are formed of different materials; wherein the connector core is formed of a material that is more resilient than the core shell; wherein the connection element core portion and the connector peg are formed of different materials; wherein the connector core is formed of a material that is more resilient than the connector peg; and wherein the toy construction kit is configured such that at least a subset of the plurality of toy construction pieces may be assembled into each of a plurality of distinct constructed assemblies; and wherein the connector peg includes a peg head with a peg head diameter, as measured in a direction at least substantially perpendicular to the peg axis; wherein the connection element core portion includes a shoulder that at least partially defines the receiver cavity; wherein the shoulder has a shoulder diameter; wherein the peg head diameter is larger than the shoulder diameter; and wherein at least one of the shoulder and the peg head is configured to resiliently deform to permit the peg head to pass into and out of the receiver cavity.

10. The toy construction kit of claim 9, wherein at least a subset of the plurality of toy construction pieces includes a plurality of structural blocks, wherein each structural block is configured to be selectively coupled to each of at least two other toy construction pieces of the plurality of toy construction pieces.

11. The toy construction kit of claim 10, wherein:

(i) at least one structural block of the plurality of structural blocks includes at least one male connection element and at least one female connection element; or (ii) at least one structural block of the plurality of structural blocks includes at least two male connection elements; or (iii) at least one structural block of the plurality of structural blocks includes at least two female connection elements.

12. The toy construction kit of claim 11, wherein at least one structural block of the plurality of structural blocks includes the connector core and the core shell; wherein the at least one structural block of the plurality of structural blocks includes the at least two female connection elements; wherein the connector core includes the connection element core portion of each female connection element of the at least two female connection elements; and wherein the core shell includes the connection element shell portion of each female connection element of the at least two female connection elements.

13. The toy construction kit of claim 9, wherein at least one toy construction piece of the plurality of toy construction pieces is a terminal piece that is configured to be selectively coupled to only one other toy construction piece of the plurality of toy construction pieces, wherein the terminal piece includes only one of the male connection element or the female connection element.

14. The toy construction kit of claim 9, wherein at least one toy construction piece of the plurality of toy construction pieces takes the appearance of one or more of a passenger module, a cockpit, an engine, a jet engine, a rocket engine, a turbofan engine, an exhaust port, an aerodynamic surface, a wing, an aerodynamic stabilizer, a rudder, a fin, a weapon, a gun, a missile bank, a storage tank, and a fuel tank.

15. The toy construction kit of claim 9, wherein at least one toy construction piece of the plurality of toy construction pieces is a double male piece that includes the male connection element; wherein the male connection element of the double male piece is a first male connection element with a first connector peg extending along a first peg axis; and wherein the double male piece additionally includes a second male connection element with a second connector peg extending along a second peg axis.

16. The toy construction kit of claim 15, wherein the first peg axis is parallel to the second peg axis.

17. The toy construction kit of claim 9, wherein each toy construction piece of the plurality of toy construction pieces has a maximum dimension that is at least 10 millimeters (mm) and at most 70 mm.

18. The toy construction kit of claim 9, wherein the plurality of toy construction pieces includes at least a first toy construction piece and a second toy construction piece; wherein the first toy construction piece includes the male connection element; wherein the second toy construction piece includes the connector core, the core shell, and the female connection element; wherein the receiver cavity is configured to selectively and repeatedly receive at least a portion of the connector peg to selectively and repeatedly couple the male connection element and the female connection element to one another to selectively and repeatedly couple the first toy construction piece and the second toy construction piece to one another and to selectively and repeatedly uncouple the first toy construction piece and the second toy construction piece from one another.

19. The toy construction kit of claim 18, wherein the connector core of the second toy construction piece is operatively coupled to at least a portion of the core shell of the second toy construction piece.

20. The toy construction kit of claim 9, wherein at least one toy construction piece of the plurality of toy construction pieces includes the connector core, the core shell, and the female connection element; wherein the connector core defines a plurality of receiver cavities; wherein the female connection element is a first female connection element; wherein the receiver cavity of the first female connection element is a first receiver cavity of the plurality of receiver cavities; and wherein the toy construction piece further includes at least a second female connection element that includes a second receiver cavity of the plurality of receiver cavities.

21. A toy construction kit, comprising:

a first toy construction piece including a male connection element; and a second toy construction piece including a connector core, a core shell that extends on an exterior side of the connector core, and a female connection element;

wherein the male connection element includes a peg unit with a connector peg that extends along a peg axis;

wherein the female connection element includes:

a connection element core portion of the connector core that defines a receiver cavity; and a connection element shell portion of the core shell;

wherein the receiver cavity is configured to selectively and repeatedly receive at least a portion of the connector peg to selectively and repeatedly couple the male connection element and the female connection element to one another to operatively couple the first toy construction piece with the second toy construction piece; wherein the connector peg is configured to be selectively and repeatedly removed from the receiver cavity to selectively and repeatedly uncouple the male connection element and the female connection element to selectively uncouple the first toy construction piece and the second toy construction piece from one another; wherein the connector core and the core shell are formed of different materials; wherein the connector core is formed of a material that is more resilient than the core shell; wherein the connector core and the connector peg are formed of different materials; and wherein the connector core is formed of a material that is more resilient than the connector peg; and wherein the peg unit additionally includes a peg base, wherein the connector peg extends away from the peg base along the peg axis, wherein the female connection element includes an alignment guide that is defined by the core shell, and wherein the alignment guide receives at least a portion of the peg base when the male connection element is operatively coupled to the female connection element.

22. The toy construction kit of claim 21, wherein the alignment guide includes a plurality of alignment notches, wherein the peg base includes a plurality of corners, and wherein each corner of the plurality of corners is at least partially received within a corresponding alignment notch of the plurality of alignment notches when the male connection element of the first toy construction piece is operatively coupled to the female connection element of the second toy construction piece.

23. The toy construction kit of claim 22, wherein the plurality of alignment notches defines a plurality of discrete rotational orientations of the peg base relative to the alignment guide when the male connection element of the first toy construction piece is operatively coupled to the female connection element of the second toy construction piece.

24. The toy construction kit of claim 21, wherein the alignment guide includes a plurality of alignment notches, wherein the peg base does not extend within any of the plurality of alignment notches when the male connection element of the first toy construction piece is operatively coupled to the female connection element of the second toy construction piece, and wherein the male connection element is free to rotate with respect to the female connection element about the peg axis when the male connection element of the first toy construction piece is operatively coupled to the female connection element of the second toy construction piece.

25. The toy construction kit of claim 21, wherein the core shell substantially covers the connector core.

26. A toy construction kit, comprising:

a plurality of toy construction pieces; wherein at least one toy construction piece of the plurality of toy construction pieces includes a male connection element that includes a peg unit with a connector peg that extends along a peg axis; wherein at least one other toy construction piece of the plurality of toy construction pieces includes a female connection element that includes a connection element core portion and a connection element shell portion, wherein the connection element core portion defines a receiver cavity;

wherein each toy construction piece of the plurality of toy construction pieces that includes the female connection element additionally includes a connector core and a core shell such that the connection element core portion is at least a portion of the connector core and such that the connection element shell portion is at least a portion of the core shell; wherein the connection element core portion and the connection element shell portion are formed of different materials; wherein the connector core is formed of a material that is more resilient than the core shell; wherein the connection element core portion and the connector peg are formed of different materials; wherein the connector core is formed of a material that is more resilient than the connector peg; and wherein the toy construction kit is configured such that at least a subset of the plurality of toy construction pieces may be assembled into each of a plurality of distinct constructed assemblies; and wherein the peg unit additionally includes a peg base, wherein the connector peg extends away from the peg base along the peg axis, wherein the female connection element includes an alignment guide that is defined by the core shell, and wherein the alignment guide receives at least a portion of the peg base when the male connection element is operatively coupled to the female connection element.

27. The toy construction kit of claim 26, wherein at least one toy construction piece of the plurality of toy construction pieces is a structural block that is configured to be selectively coupled to each of at least two other toy construction pieces of the plurality of toy construction pieces.

28. The toy construction kit of claim 27, wherein one or more of:

(i) the structural block includes at least one male connection element and at least one female connection element;

(ii) the structural block includes at least two male connection elements; and (iii) the structural block includes at least two female connection elements.

29. The toy construction kit of claim 26, wherein at least one toy construction piece of the plurality of toy construction pieces is a terminal piece that is configured to be selectively coupled to only one other toy construction piece of the plurality of toy construction pieces, wherein the terminal piece includes only one of the male connection element or the female connection element.

30. The toy construction kit of claim 26, wherein at least one toy construction piece of the plurality of toy construction pieces takes the appearance of one or more of a passenger module, a cockpit, an engine, a jet engine, a rocket engine, a turbofan engine, an exhaust port, an aerodynamic surface, a wing, an aerodynamic stabilizer, a rudder, a fin, a weapon, a gun, a missile bank, a storage tank, and a fuel tank.

31. The toy construction kit of claim 26, wherein at least one toy construction piece of the plurality of toy construction pieces is a double male piece that includes the male connection element; wherein the male connection element of the double male piece is a first male connection element with a first connector peg extending along a first peg axis; and wherein the double male piece additionally includes a second male connection element with a second connector peg extending along a second peg axis.

32. The toy construction kit of claim 30, wherein the first peg axis is parallel to the second peg axis.

33. The toy construction kit of claim 26, wherein each toy construction piece of the plurality of toy construction pieces has a maximum dimension that is at least 10 millimeters (mm) and at most 70 mm.

34. The toy construction kit of claim 26, wherein the plurality of toy construction pieces includes at least a first toy construction piece and a second toy construction piece; wherein the first toy construction piece includes the male connection element; wherein the second toy construction piece includes the connector core, the core shell, and the female connection element; wherein the receiver cavity is configured to selectively and repeatedly receive at least a portion of the connector peg to selectively and repeatedly couple the male connection element and the female connection element to one another to selectively and repeatedly couple the first toy construction piece and the second toy construction piece to one another and to selectively and repeatedly uncouple the first toy construction piece and the second toy construction piece from one another.

35. The toy construction kit of claim 33, wherein the connector core of the second toy construction piece is operatively coupled to at least a portion of the core shell of the second toy construction piece.

* * * * *